US011788782B2

(12) United States Patent
Kang et al.

(10) Patent No.: US 11,788,782 B2
(45) Date of Patent: Oct. 17, 2023

(54) ICE MAKER AND A REFRIGERATOR INCLUDING THE SAME

(71) Applicant: LG ELECTRONICS INC., Seoul (KR)

(72) Inventors: Sangjun Kang, Seoul (KR); Yonghyun Kim, Seoul (KR); Jinil Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/738,310

(22) Filed: May 6, 2022

(65) Prior Publication Data

US 2022/0260294 A1 Aug. 18, 2022

Related U.S. Application Data

(63) Continuation of application No. 16/863,895, filed on Apr. 30, 2020, now Pat. No. 11,371,766.

(30) Foreign Application Priority Data

Jul. 6, 2019 (KR) ..... 10-2019-0081708

(51) Int. Cl.

| | |
|---|---|
| ***F25C 1/10*** | (2006.01) |
| ***F25C 1/25*** | (2018.01) |
| ***F25C 5/20*** | (2018.01) |
| ***F25C 1/24*** | (2018.01) |

(52) U.S. Cl.

CPC ..... *F25C 1/10* (2013.01); *F25C 1/24* (2013.01); *F25C 1/25* (2018.01); *F25C 5/22* (2018.01); *F25C 2305/022* (2013.01); *F25C 2305/0221* (2021.08); *F25C 2400/10* (2013.01); *F25C 2700/00* (2013.01)

(58) Field of Classification Search

CPC ..... F25C 1/10; F25C 1/25; F25C 5/22; F25C 1/24; F25C 2305/022; F25C 2400/10; F25C 2700/10

See application file for complete search history.

(56) References Cited

U.S. PATENT DOCUMENTS

| | | | |
|---|---|---|---|
| 2007/0103940 | A1 | 5/2007 | Chung |
| 2010/0031679 | A1 | 2/2010 | Park |
| 2010/0319385 | A1 | 12/2010 | Hashimoto |

(Continued)

FOREIGN PATENT DOCUMENTS

| | | |
|---|---|---|
| CN | 1963346 | 5/2007 |
| CN | 104272043 | 1/2015 |

(Continued)

OTHER PUBLICATIONS

Extended European Search Report in European Appln. No. 22166071.5, dated Jul. 18, 2022, 10 pages.

(Continued)

*Primary Examiner* — Elizabeth J Martin

(74) *Attorney, Agent, or Firm* — Fish & Richardson P.C.

(57) ABSTRACT

In a refrigerator, a cam of a cam gear rotating by a driving motor is provided with a structure protruding from an edge portion of a cam gear to a center, thereby increasing the thickness of a cam surface. Therefore, it is possible to reduce the magnitude of force directly transferred from the cam gear to a magnet lever.

20 Claims, 28 Drawing Sheets

(56) References Cited

U.S. PATENT DOCUMENTS

| | | | | |
|---|---|---|---|---|
| 2013/0233010 | A1* | 9/2013 | Choi | F25C 5/187<br>62/340 |
| 2015/0082816 | A1 | 3/2015 | Park | |
| 2020/0080759 | A1 | 3/2020 | Shi et al. | |
| 2021/0348821 | A1 | 11/2021 | Lee et al. | |

FOREIGN PATENT DOCUMENTS

| | | |
|---|---|---|
| EP | 3628943 | 4/2020 |
| EP | 3862671 | 8/2021 |
| JP | H1183259 | 3/1999 |
| KR | 20010051251 | 6/2001 |
| KR | 20190026453 | 3/2019 |
| WO | WO2020071766 | 4/2020 |

OTHER PUBLICATIONS

Extended European Search Report in European Appln. No. 20175595.6, dated Oct. 19, 2020, 9 pages.
Office Action in Chinese Appln. No. 202010175656.2, dated Oct. 9, 2021, 10 pages (with English translation).

* cited by examiner

ICE MAKER AND A REFRIGERATOR INCLUDING THE SAME

CROSS-REFERENCE TO RELATED APPLICATIONS

The present application is a continuation of U.S. application Ser. No. 16/863,895, filed on Apr. 30, 2020, which claims priority under 35 U.S.C. 119 and 35 U.S.C. 365 to Korean Patent Application No. 10-2019-0081708, filed on Jul. 6, 2019, the contents of which are hereby incorporated by reference in their entirety.

BACKGROUND

The present disclosure relates to an ice maker and a refrigerator including the same.

Generally, an ice maker for making ice is provided in a refrigerator. The ice maker may produce (make) ice by accommodating water supplied from a water source or a water tank in a tray and then cooling the water. The made ice may be transferred from the ice tray in a heating manner or a twisting manner.

The ice maker is formed to be opened upward and is configured such that the made ice is pumped up. The made ice may have at least one flat surface and have a crescent or cubic shape.

When the ice has a spherical shape, it is more convenient to use the ice, and also, it is possible to provide a user with different feeling of use. In addition, even when the made ice is stored, a contact area between the ice cubes may be minimized to minimize a mat of the ice cubes.

In connection with such an ice maker, the following prior art document is disclosed.

Prior Art Information

1. Publication NO. (Publication date): 2001-0051251 (Jun. 25, 2001)

2. Title of the Invention: Driving device of automatic ice maker, automatic ice maker and refrigerator The refrigerator of the prior art document includes an automatic ice maker, an ice making plate, an ice storage container, in which ice is received, in the ice plate, and an ice detection arm for detecting the amount of ice in the ice storage container.

The ice making plate may separate ice by twisting operation (rotation operation) and the ice detection arm may detect the amount of ice in the ice storage container by up-and-down rotation. The ice detection arm may rotate by power received from a DC motor.

However, according to the prior art document, since a part of the ice detection arm is lowered to enter the ice storage container in a state in which the ice detection arm is located on the side of the DC motor, a space where the ice detection arm rotates needs to be formed on the side of the DC motor.

In addition, when assembly tolerance occurs between the ice detection arm and the DC motor, the ice detection arm rubs against or collides with a surrounding structure while the ice detection arm rotates, thereby causing detection failure.

In addition, when the ice detection arm rotates such that the ice is separated from the ice making plate and is dropped into the ice making container in a state in which a portion of the ice detection arm is located in the ice storage container, the ice may be stuck between the ice detection arm and the ice making plate.

In addition, when a cam gear rotates and a lever moves along a cam surface, force transferred from the cam surface to the lever may not be balanced such that a lever shaft is distorted. Therefore, the signal of a sensor may not be easily detected.

SUMMARY

The present embodiment provides an ice maker that may produce ice having uniform transparency, and a refrigerator including the same.

The present embodiment provides an ice maker capable of easily transferring power while a tray moves to a water supply position, an ice making position or an ice transfer position, and a refrigerator including the same.

The present embodiment provides an ice maker capable of preventing distortion or shaking of a magnet lever moving along a cam surface, by improving the shape of the cam surface of a cam gear rotating by a driving motor, and a refrigerator including the same.

Specifically, the present embodiment provides an ice maker capable of reducing the magnitude of force directly transferred from a cam gear to a magnet lever by increasing the thickness of a cam surface protruding to the inside of the edge portion of a cam gear, and a refrigerator including the same.

The present embodiment provides an ice maker capable of increasing a stroke transferred from a cam gear to a magnet lever, that is, pressing force or a pressing distance transferred from the cam gear to the magnet lever, by providing a structure protruding toward the center of the cam gear to each portion of a cam corresponding to the position (the water supply position, the ice making position or the ice transfer position) of a tray, and a refrigerator including the same.

The present embodiment provides an ice maker capable of reducing assembly tolerance between a magnet lever and a case, by integrally configuring the case and a shaft support firmly supporting the shaft of the magnet lever supported on the case, and a refrigerator including the same.

A refrigerator according to an embodiment of the present disclosure can reduce the magnitude of force directly transferred to a cam gear to a magnet lever, by increasing the thickness of a cam surface by providing a structure protruding from an edge portion of the cam gear to the center to the cam of the cam gear rotating by a driving motor.

Accordingly, since it is possible to prevent distortion or shaking of the magnet lever, correct-position signal detection of a magnet and a Hall sensor can be easily performed.

The cam of the cam gear includes a plurality of cam portions contacting at a point corresponding to each position when a tray moves to a water supply position, an ice making position or an ice transfer position, and the plurality of cam portions may have a structure protruding toward the center of the cam gear.

By this configuration, since a stroke transferred to a cam gear to a magnet lever, that is, pressing force or a pressing distance transferred to the cam gear to the magnet lever, can increase, correct-position signal detection of a magnet and a Hall sensor can be easily performed.

In addition, the magnet lever includes a lever shaft supported on a case, and the lever shaft may be firmly supported by a shaft support integrally configured with the case. It is possible to prevent distortion or shaking of the magnet lever, by coupling between the lever shaft and the shaft support.

An ice maker according to an embodiment of the present disclosure includes a tray provided in a storage compartment to form an ice chamber, and a driving device configured to move the tray to a water supply position, an ice making position and an ice transfer position and coupled with a full ice detection lever.

The driving device includes a driving motor, a cam gear configured to rotate by the driving motor and including a shaft, an edge portion forming a gear portion, a first lever cam surrounding the shaft, and a second lever cam protruding from the edge portion in a circumferential direction, a magnet lever provided to be movable in contact with the first lever cam and provided with a magnet, and an operation lever provided to be movable in contact with the second lever cam to move the full ice detection lever.

The first lever cam includes at least three cam portions protruding from the edge portion of the cam gear toward a center of the cam gear with different heights, and the three cam portions are distinguished by steps interfering with the magnet lever.

The three cam portions may include a first cam portion having a first contact surface extending between a first step and a second step in the circumferential direction, a second cam portion distinguished from the first cam portion by the second step and having a second contact surface extending in the circumferential direction, and a third cam portion distinguished from the second cam portion by a third step and having a third contact surface extending in the circumferential direction.

The first cam portion may include a step connector connected to the second step and having a constant thickness from the first step toward the second step in the circumferential direction, and a thickness S3 of the step connector of the first cam portion protruding from the edge portion of the cam gear toward the center may be in a range of 30 to 50% of a maximum thickness S2 of the second step.

The second cam portion may include a step connector connected to the third step and having a constant thickness from the second step toward the third step in the circumferential direction, and a thickness S3 of the step connector of the second cam portion protruding from the edge portion of the cam gear toward the center may be in a range of 30 to 50% of a maximum thickness S2 of the third step.

The third cam portion may include a step connector forming an end of the first cam portion and having a constant thickness in the circumferential direction, and the step connector of the third cam portion may have the same shape and size as the step connectors of the first and second cam portions.

A first contact surface of the first cam portion may include an unevenness in which contact occurs when the tray is located at the ice making position, and the unevenness may include a protrusion protruding from the edge portion of the cam gear toward a center of the cam gear, a first inclined portion obliquely extending from the protrusion toward the first step, and a second inclined portion obliquely extending from the protrusion toward the second step.

The magnet lever may include a lever body extend to be rounded or bent, the magnet may be provided at one side of the lever body, and a projection contacting the first inclined portion or the second inclined portion may be provided at the other side of the lever body.

A second contact surface of the first cam portion may include a portion, with which the magnet lever is in contact, when the tray is located at the water supply position.

A second contact surface of the second cam portion may include an unevenness in which contact occurs when the tray is located at the full ice detection position, and the unevenness may include a protrusion protruding from the edge portion of the cam gear toward a center of the cam gear, a first inclined portion obliquely extending from the protrusion toward the second step, and a second inclined portion obliquely extending from the protrusion toward the third step.

A third contact surface of the third cam portion may include an unevenness in which contact occurs when the tray is located at the ice transfer position, and the unevenness may include a protrusion protruding from the edge portion of the cam gear toward a center of the cam gear, a first inclined portion obliquely extending from the protrusion toward the third step, and a second inclined portion obliquely extending from the protrusion toward an end of the third cam portion.

The driving device may further include a case having a shaft support, and the magnet lever may include a lever shaft rotatably coupled to the shaft support.

The shaft support may be insert injected into the case and is integrally configured.

The cam gear may include a first groove formed between the edge portion of the cam gear and the first cam portion, a second groove formed between the edge portion of the cam gear and the second cam portion, and a third groove formed between the edge portion of the cam gear and the third cam portion.

The driving device may further include a Hall sensor configured to output a first signal and a second signal according to a relative position with the magnet lever.

DETAILED DESCRIPTION

Exemplary embodiments of the present invention will be described below in detail with reference to the accompanying drawings in which the same reference numbers are used throughout this specification to refer to the same or like parts. In describing the present invention, a detailed description of known functions and configurations will be omitted when it may obscure the subject matter of the present invention.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
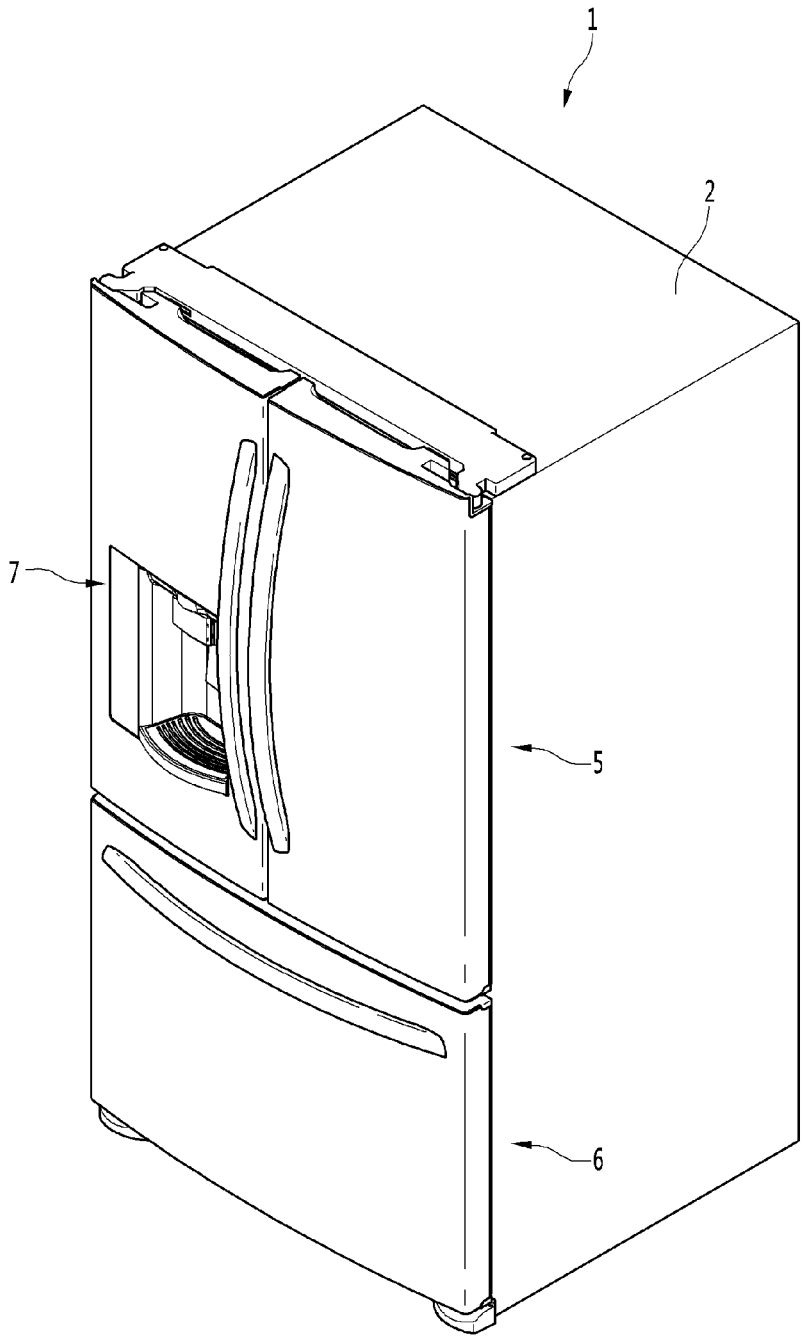
FIG. 1 is a perspective view of a refrigerator according to one embodiment of the present disclosure.
Figure 2:
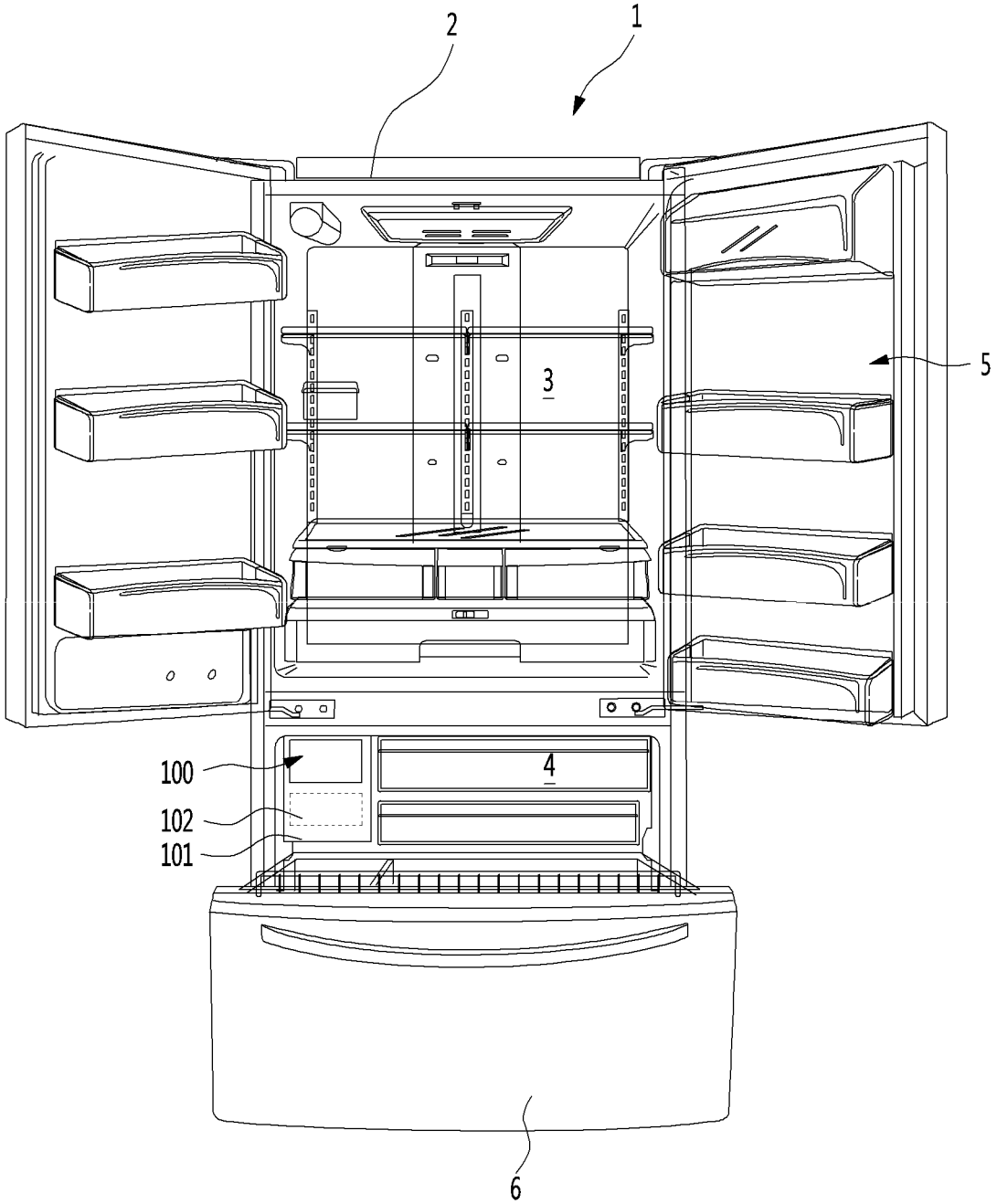
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the made ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

The freezing compartment 100 may be provided with a duct (not shown) for supplying cold air to the freezing compartment 100. Air discharged from the duct may flow to the ice maker 100 and then flow to the freezing compartment 5.

For another example, a dispenser 7 for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

Alternatively, the ice maker 100 may be provided in the door that opens or closes the refrigerating compartment or the freezing compartment.

Hereinafter, the ice maker will be described in detail with reference to the accompanying drawings.

Figure 3:
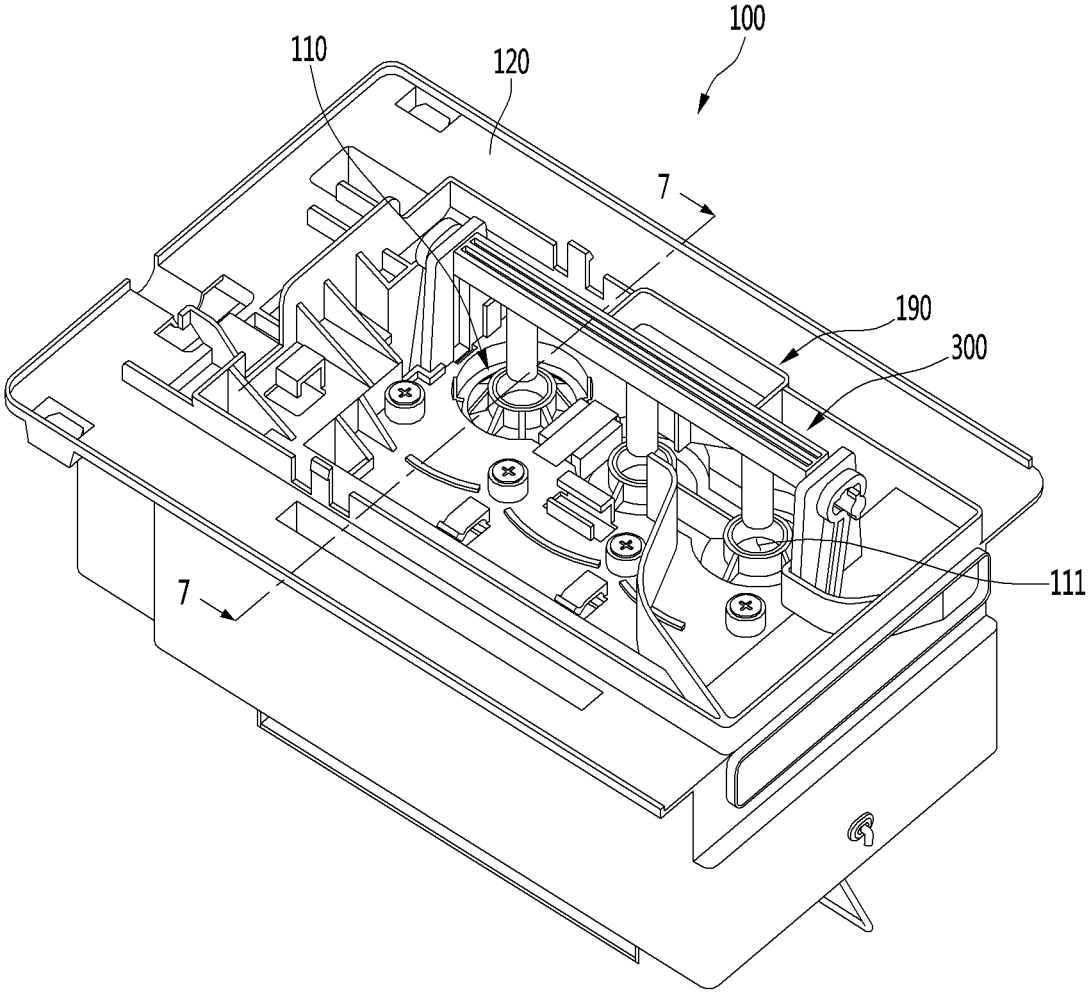
FIG. 3 is a top perspective view of an ice maker according to one embodiment of the present disclosure.
Figure 4:
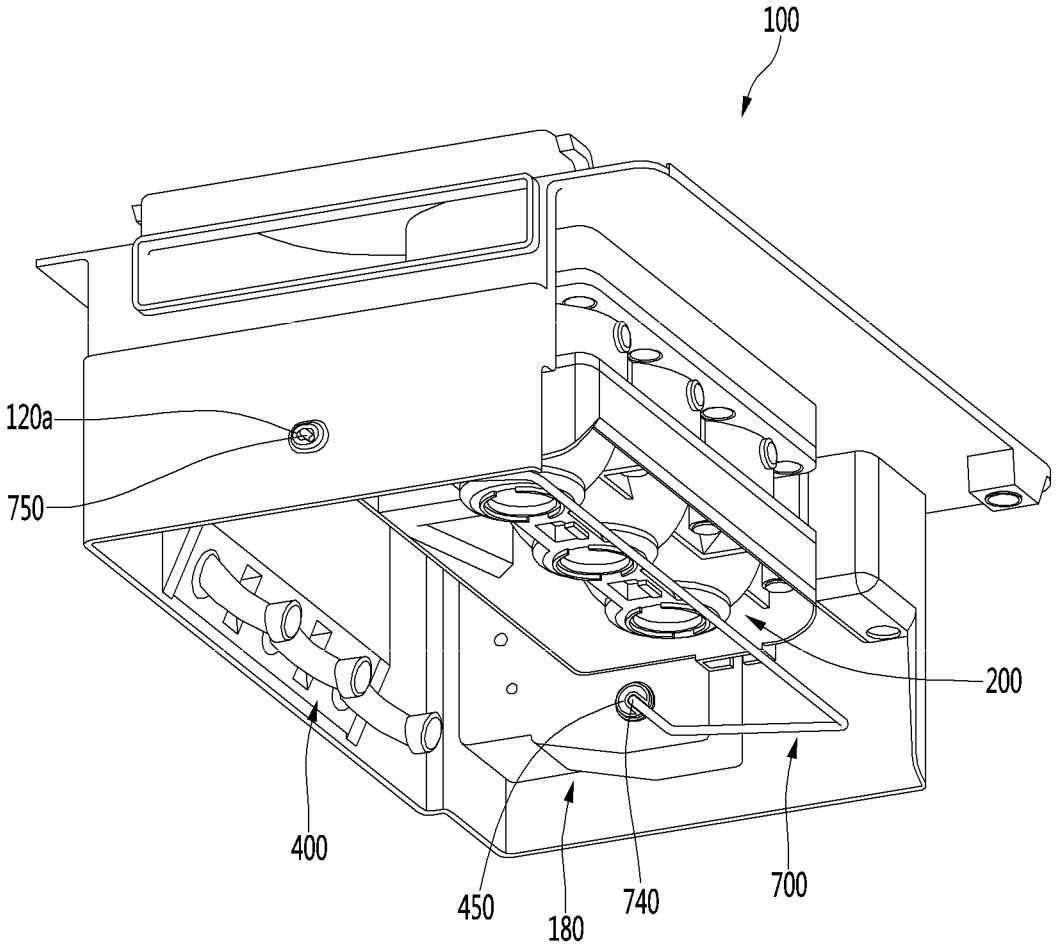
FIG. 4 is a bottom perspective view of an ice maker according to one embodiment of the present disclosure.
Figure 5:
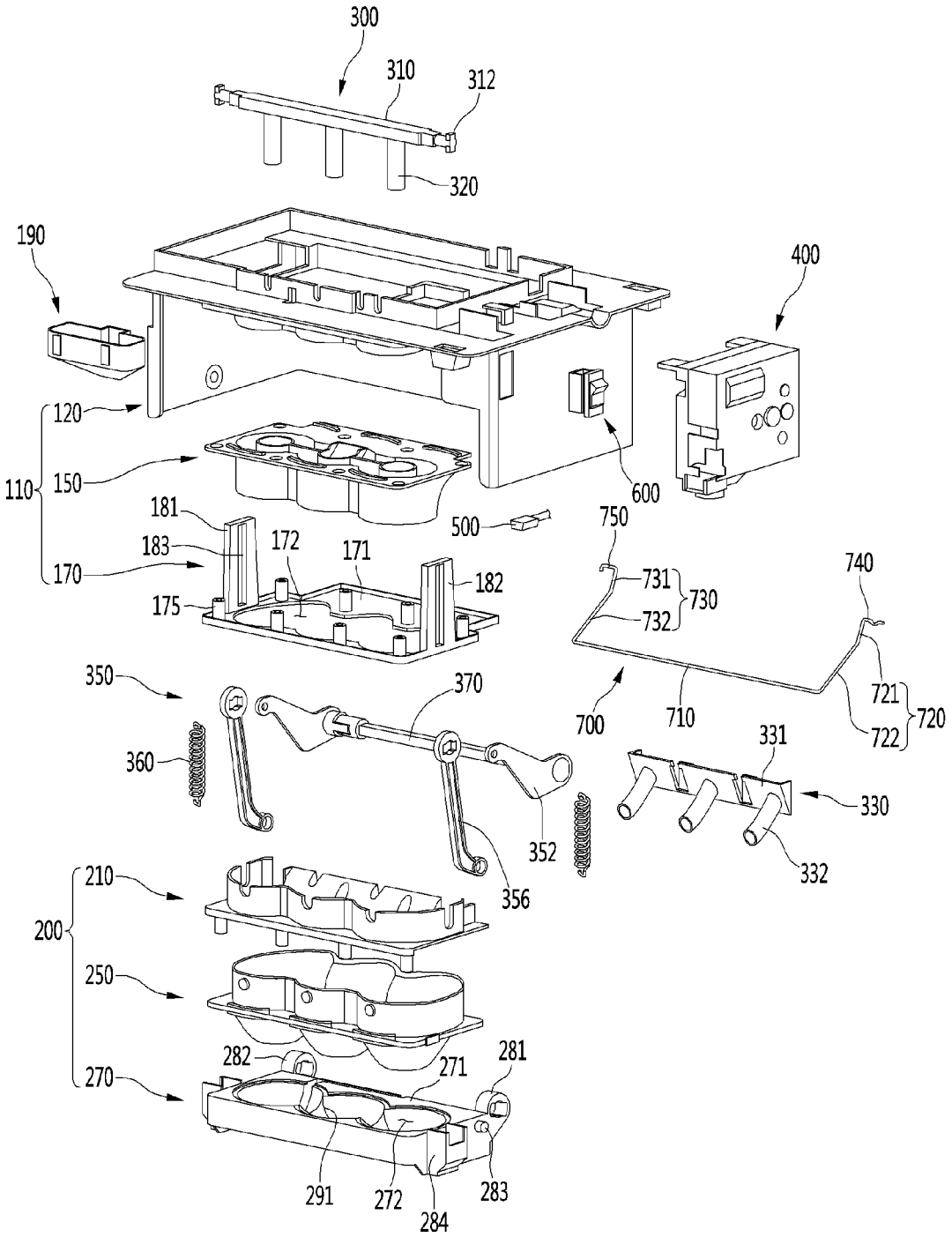
FIG. 5 is an exploded perspective view of an ice maker according to one embodiment of the present disclosure.

FIG. 3 is a top perspective view of an ice maker according to one embodiment of the present disclosure, FIG. 4 is a bottom perspective view of an ice maker according to one embodiment of the present disclosure, and FIG. 5 is an exploded perspective view of an ice maker according to one embodiment of the present disclosure.

Referring to FIGS. 3 to 5, the ice maker 100 may include an upper assembly 110 (or upper tray assembly) and a lower assembly 200 (or lower tray assembly).

The upper assembly 110 may be referred to as a first tray assembly and the lower assembly 200 may be referred to as a second tray assembly.

The lower assembly 200 may move relative to the upper assembly 110. For example, the lower assembly 200 may rotate relative to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

Of course, the upper assembly 110 and the lower assembly 200 may produce ice having various shapes other than the spherical ice.

As used herein, a term "spherical or hemisphere form" not only includes a geometrically complete sphere or hemisphere form but also a geometrically complete sphere-like or geometrically complete hemisphere-like form.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving device 400 such that lower assembly 200 rotates relative to the upper assembly 110.

The driving device 400 may include a driving motor and a power transmission part for transmitting the power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and one or more upper ejecting pins 320 extending in a direction crossing the ejector body 310. Although not limited thereto, the number of upper ejecting pins 320 may be equal to the number of ice chambers 111.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 330 so that the ice closely attached to the lower assembly 200 is capable of being separated.

The lower ejector 330 may press the lower assembly 200 to separate the ice closely attached to the lower assembly 200 from the lower assembly 200. For example, the lower ejector 330 may be fixed to the upper assembly 110.

The lower ejector 330 may include an ejector body 331 and one or more lower ejecting pins 332 protruding from the ejector body 331. The number of lower ejecting pins 332 may be equal to the number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 with the upper ejector 300. The connection unit 350 may include one or more links.

For example, the connection unit 350 may include a first link 352 for rotating a lower supporter 270 and a second link 356 connected to the lower supporter 270 to transfer rotation force of the lower supporter 270 to the upper ejector 300 when the lower supporter 270 rotates.

For example, when the lower assembly 200 rotates in a forward direction, the upper ejector 300 is lowered by the connection unit 350 such that the upper ejecting pins 320 press the ice. In contrast, when the lower assembly 200 rotates in the reverse direction, the upper ejector 300 may rise by the connection unit 350 to return to an original position thereof.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111. The upper tray 150 may be called as a first tray. Alternatively, the upper tray 150 may be called as an upper mold part.

The upper assembly 110 may further include an upper case 120 and an upper supporter 170 for fixing the position of the upper tray 150.

The upper tray 150 may be located below the upper case 120. A portion of the upper supporter 170 may be located below the upper tray 150.

The upper case 120, the upper tray 150 and the upper supporter 170 aligned in a vertical direction may be fastened by a fastening member. That is, the upper tray 150 may be fixed to the upper case 120 through fastening of the fastening member.

The upper supporter 170 may support the lower side of the upper tray 150 to restrict downward movement thereof.

For example, the water supply part 190 may be fixed to the upper case 120.

The ice maker 100 may further include a temperature sensor 500 detecting a temperature of water or a temperature of ice of the ice chamber 111.

In one example, the temperature sensor 500 may indirectly detect the temperature of the water or the temperature of the ice in the ice chamber 111 by detecting the temperature of the upper tray 150.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111. The lower tray 250 may be called as a second tray. Alternatively, the lower tray 250 may be called as a lower mold part.

The lower assembly 200 may further include a lower supporter 270 supporting the lower side of the lower tray 250, and a lower case 210, at least a portion of which covers the upper side of the lower tray 250. The lower case 210, the lower tray 250 and the lower supporter 270 may be fastened by a fastening member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice transfer process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

The ice maker 100 may further include a full ice detection lever 700. The full ice detection lever 700 may detect the full ice state of the ice bin 102 while rotating using the power received from the driving device 400.

One side of the full ice detection lever 700 may be connected to the driving device 400 and the other side thereof may be coupled to the upper case 120.

For example, the other side of the full ice detection lever 700 may be rotatably connected to the upper case 120 below the connection shaft 370 of the connection unit 350. Accordingly, the center of rotation of the full ice detection lever 700 may be located at a lower position than the connection shaft 370.

In addition, the driving device 400 may further include a cam gear 430 rotating using rotation power received from the driving motor and having a cam surface, and a magnet lever 460 (see FIG. 14) moving along the cam surface. The magnet lever 460 may be provided with the magnet 468 (see FIG. 14). The driving device 400 may further include a Hall sensor 423 capable of detecting the magnet 468 while the magnet lever 460 moves.

The full ice detection lever 700 may be coupled to the driving device 400 to rotate together when the lower assembly 200 rotates.

Depending on whether the Hall sensor 423 detects the magnet 468, the Hall sensor 423 may output a first signal and a second signal which are different outputs. One of the first signal and the second signal may be a high signal and the other thereof may be a low signal.

The full ice detection lever 700 may rotate from a standby position (the ice making position of the lower assembly) to a full ice detection position, for full ice detection.

In a state in which the full ice detection lever 700 is located at the standby position, at least a portion of the full ice detection lever 700 may be located below the lower assembly 200.

The full ice detection lever 700 may include a detection body 710. The detection body 710 may be located at the lowermost side during the rotation operation of the full ice detection lever 700.

In order to prevent interference between the lower assembly 200 and the detection body 710 during the rotation operation of the lower assembly 200, the whole of the detection body 710 may be located below the lower assembly 200. The detection body 710 may contact the ice in the ice bin 102 in the full ice state of the ice bin 102.

The full ice detection lever 700 may be a lever having a wire shape. That is, the full ice detection lever 700 may be formed by bending a wire having a predetermined diameter multiple times.

The detection body 710 may extend in a direction parallel to the extension direction of the connection shaft 370. The detection body 710 may be located at a position lower than the lowermost point of the lower assembly 200 regardless of the position.

The full ice detection lever 700 may further include a pair of extensions 720 and 730 extending upward from both ends of the detection body 710. The pair of extensions 720 and 730 may extend substantially in parallel. The pair of extensions 720 and 730 may include a first extension 720 and a second extension 730.

The horizontal length of the detection body 710 may be greater than the vertical length of the pair of extensions 720 and 730. A gap between the pair of extensions 720 and 730 may be greater than the horizontal length of the lower assembly 200. Accordingly, during the rotation operation of the full ice detection lever 700 and the rotation operation of the lower assembly 200, it is possible to prevent interference between the pair of extensions 720 and 730 and the lower assembly 200.

Each of the pair of extensions 720 and 730 may include first extension bars 722 and 732 extending from the detection body 710 and second extension bars 721 and 731 extending from the first extension bars 722 and 732 to be inclined at a predetermined angle.

The full ice detection lever 700 may further include a pair of coupling portions 740 and 750 bent and extending from the ends of the pair of extensions 720 and 730. The pair of coupling portions 740 and 750 may include a coupling portion 740 extending from the first extension 720 and a second coupling portion 750 extending from the second extension 730.

For example, the pair of coupling portions 740 and 750 may extend from the second extension bars 721 and 731. The first coupling portion 740 and the second coupling portion 750 may extend in a direction away from the extensions 720 and 730. The first coupling portion 740 may be connected to the driving device 400 and the second coupling portion 750 may be connected to the upper case 120.

At least a portion of the first coupling portion 740 may extend in a horizontal direction. That is, at least a portion of the first coupling portion 740 may be parallel to the detection body 710. The first coupling portion 740 and the second coupling portion 750 provide the center of rotation of the full ice detection lever 700.

In the present embodiment, the second coupling portion 750 may be coupled to the upper case 120 in an idle state. Accordingly, the first coupling portion 740 may substantially provide the center of rotation of the full ice detection lever 700.

The second coupling portion 750 may penetrate through the upper case 120. A hole 120*a*, through which the second coupling portion 750 penetrates, may be formed in the upper case 120.

Figure 6:
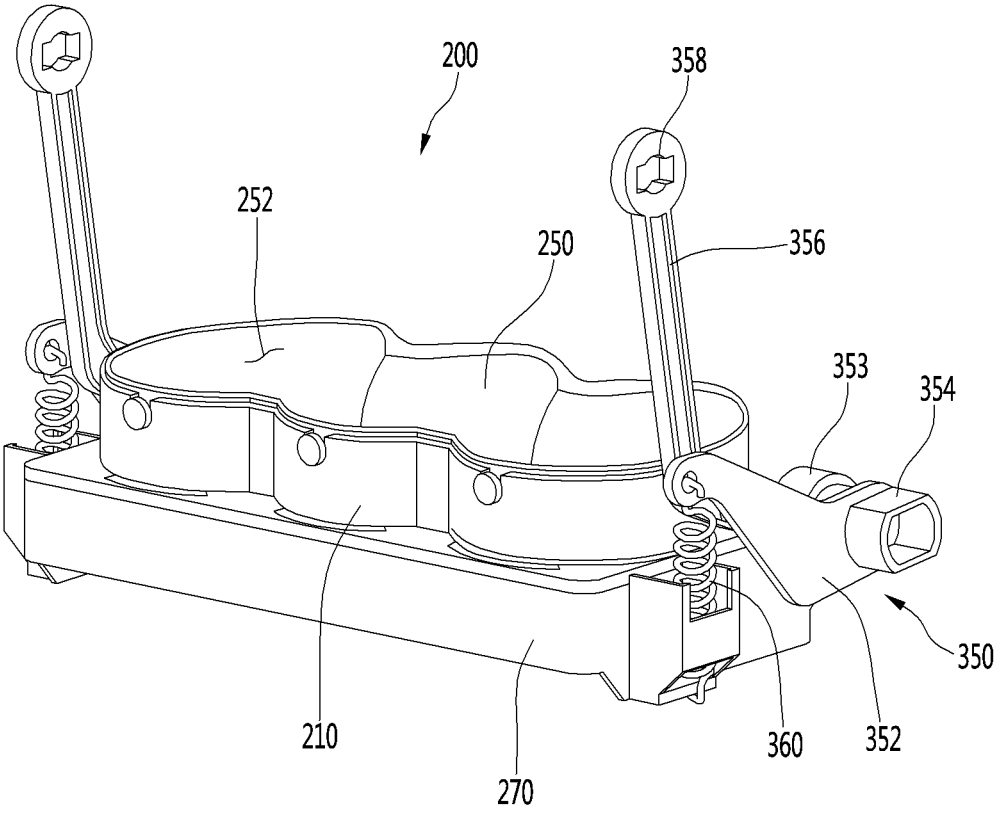
FIG. 6 is a perspective view of a lower assembly according to one embodiment of the present disclosure.

FIG. 6 is a perspective view of a lower assembly according to one embodiment of the present disclosure.

Referring to FIG. 6, the lower assembly 200 may include a lower tray 250 and a lower supporter 270. The lower assembly 200 may further include a lower case 210.

The lower case 210 may surround a portion of the circumference of the lower tray 250 and the lower supporter 270 may support the lower tray 250. The connection unit 350 may be coupled to the lower supporter 270.

The connection unit 350 may include a first link 352 for receiving the power of the driving device 400 and rotating the lower supporter 270 and a second link 356 connected to the lower supporter 270 to transfer, to the upper ejector 300, the rotation force of the lower supporter 270 when the lower supporter 270 rotates.

The first link 352 and the lower supporter 270 may be connected by an elastic member 360. The elastic member 360 may be a coil spring, for example. One end of the elastic member 360 is connected to the first link 352 and the other end thereof is connected to the lower supporter 270.

The elastic member 360 provides elastic force to the lower supporter 270 to maintain the contact state between the upper tray 150 and the lower tray 250.

In the present embodiment, the first link 352 and the second link 356 may be located at both sides of the lower supporter 270. One of the two first links 352 is connected to the driving device 400 to receive rotation force from the driving device 400.

The two first links 352 may be connected by a connection shaft 370.

A hole 358, through which the ejector body 310 of the upper ejector 300 penetrates, may be formed in the upper end of the second link 356.

The lower supporter 270 may further include a plurality of hinge bodies 281 and 282 for connection with the hinge supporters 135 and 136 of the upper case 210.

The plurality of hinge bodies 281 and 282 may be disposed to be spaced apart from each other. Each of the hinge bodies 281 and 282 may further include a hinge hole. The shaft connector 353 of the first link 352 may penetrate through the hinge hole. The connection shaft 370 may be connected to the shaft connector 353.

The lower supporter 270 may further include a coupling shaft 283 rotatably connected with the second link 356. The coupling shaft 383 may be provided on each of the both surfaces of an outer wall of the lower supporter 270.

The lower supporter 270 may further include an elastic member coupler 284 for coupling of the elastic member 360. The elastic member coupler 284 may form a space in which a portion of the elastic member 360 may be accommodated.

The first link 352 may further include a shaft bracket 354, to which the upper shaft 431*a* of the cam gear 430 is coupled. The shaft connector 353 may be provided on one of both surfaces of the first link 352 and the shaft bracket 354 may be provided on the other surface. One surface and the other surface may form opposite surfaces.

Figure 7:
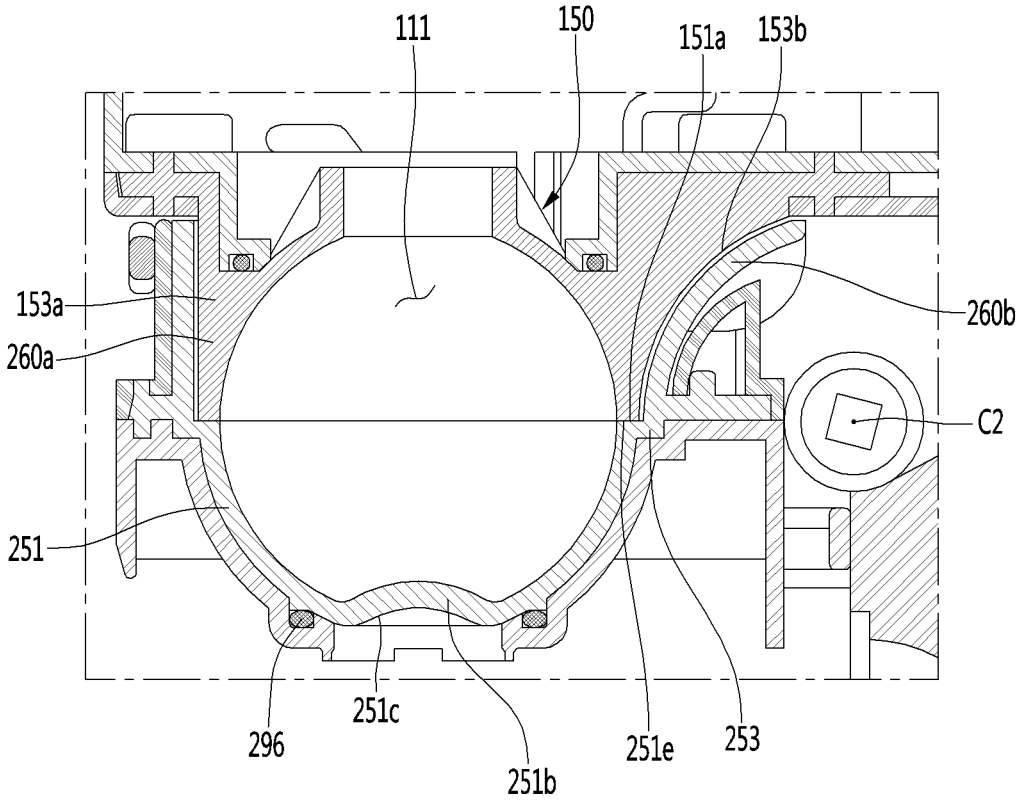
FIG. 7 is a cross-sectional view taken along line 7-7 of FIG. 3.

FIG. 7 is a cross-sectional view taken along line 7-7 of FIG. 3.

Referring to FIG. 7, a lower heater 296 may be installed in the lower supporter 270. The lower heater 296 provides heat to the ice chamber 111 in an ice making process such that ice starts to be made from the upper side in the ice chamber 111.

In addition, as the lower heater 296 generates heat in the ice making process, bubbles in the ice chamber 111 move downward during the ice making process, and the portion other than the lowermost portion of the spherical ice becomes transparent when ice making is completed. That is, according to the present embodiment, substantially transparent spherical ice may be generated.

The lower heater 296 may be, for example, a wire-type heater.

The lower heater 296 may be in contact with the lower tray 250 to provide heat to the lower chamber 252. For example, the lower heater 296 may be in contact with the lower tray body 251.

As the upper tray 150 and the lower tray 250 are brought into contact with each other in the vertical direction, the ice chamber 111 is completed. The lower surface 151*a* of the upper tray body 151 is in contact with the upper surface 251*e* of the lower tray body 251.

In a state in which the upper surface of the lower tray body 251 is in contact with the lower surface 151*a* of the upper tray body 151, the elastic force of the elastic member 360 is applied to the lower supporter 270.

The elastic force of the elastic member 360 is applied to the lower tray 250 by the lower supporter 270, such that the upper surface 251*e* of the lower tray body 251 presses the lower surface 151*a* of the upper tray body 151. Accordingly, in a state in which the upper surface 251*e* of the lower tray body 251 is in contact with the lower surface 151*a* of the upper tray body 151, the surfaces are mutually pressed, thereby improving adhesion.

In a state in which the lower surface 151*a* of the upper tray body 151 is seated on the upper surface 251*e* of the lower tray body 251, the upper tray body 151 may be accommodated in the internal space of the circumference wall 260 of the lower tray 250.

At this time, the vertical wall 153*a* of the upper tray body 151 is disposed to face the vertical wall 260*a* of the lower tray 250, and the curved wall 153*b* of the upper tray body 151 is disposed to face the curved wall 260*b* of the lower tray 250.

The lower tray body 251 may further include a convex portion 251*b* which is formed convexly upward at the lower side thereof. A depression 251*c* is formed at the lower side of the convex portion 251*b*, such that the thickness of the convex portion 251*b* is substantially equal to that of the other portion of the lower tray body 251. In this specification, "being substantially equal" may include "being completely equal" and "being not completely equal but being similar with little difference".

When cold air is supplied to the ice chamber 111 in a state in which water is supplied to the ice chamber 111, water in a liquid state is phase-changed into ice in a solid state. At this time, water is expanded when water is phase-changed into ice, and expansion force of water is transferred to the upper tray body 151 and the lower tray body 251.

In the present embodiment, the convex portion 251*b* is formed in the lower tray body 251 in consideration of deformation of the lower tray body 251, such that the shape of the made ice becomes as close as possible to a complete sphere.

In the present embodiment, water supplied to the ice chamber 111 does not have a spherical shape before the ice I is produced. However, after production of the ice I is completed, the convex portion 251*b* of the lower tray body 251 is deformed toward the lower opening 274, thereby producing the spherical ice.

Figure 8:
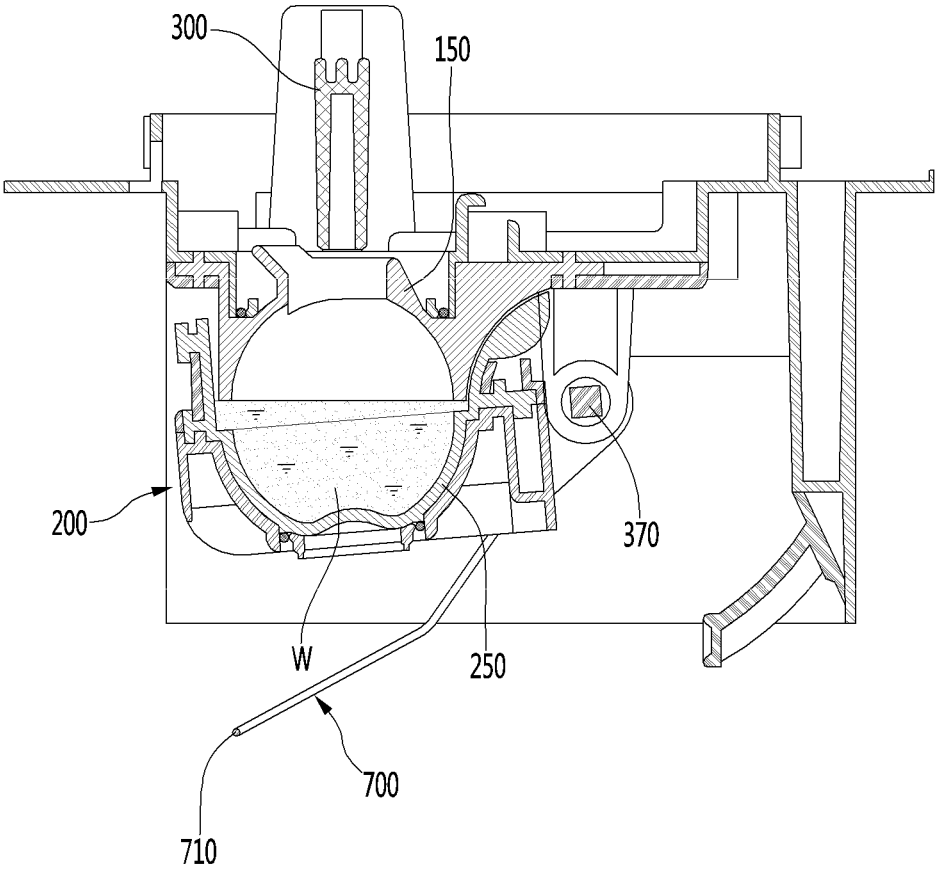
FIG. 8 is a view showing a state in which water supply is completed in a state in which a lower tray is moved to a water supply position.
Figure 9:
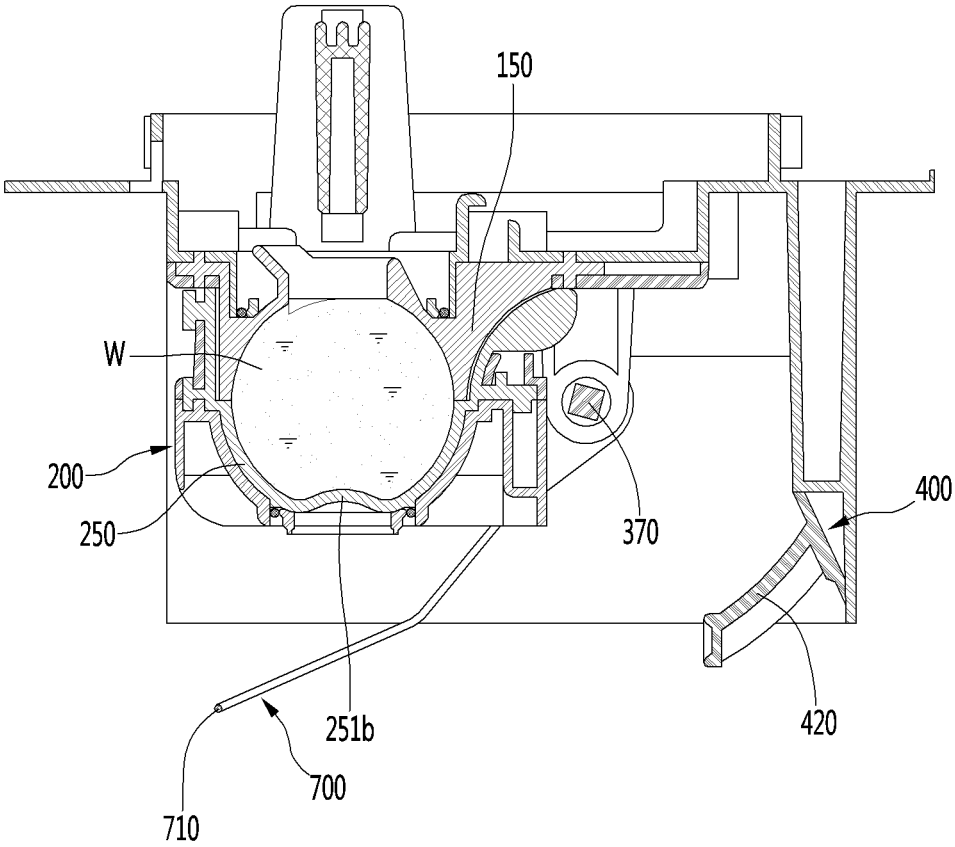
FIG. 9 is a view showing a state in which a lower tray is moved to an ice making position.
Figure 10:
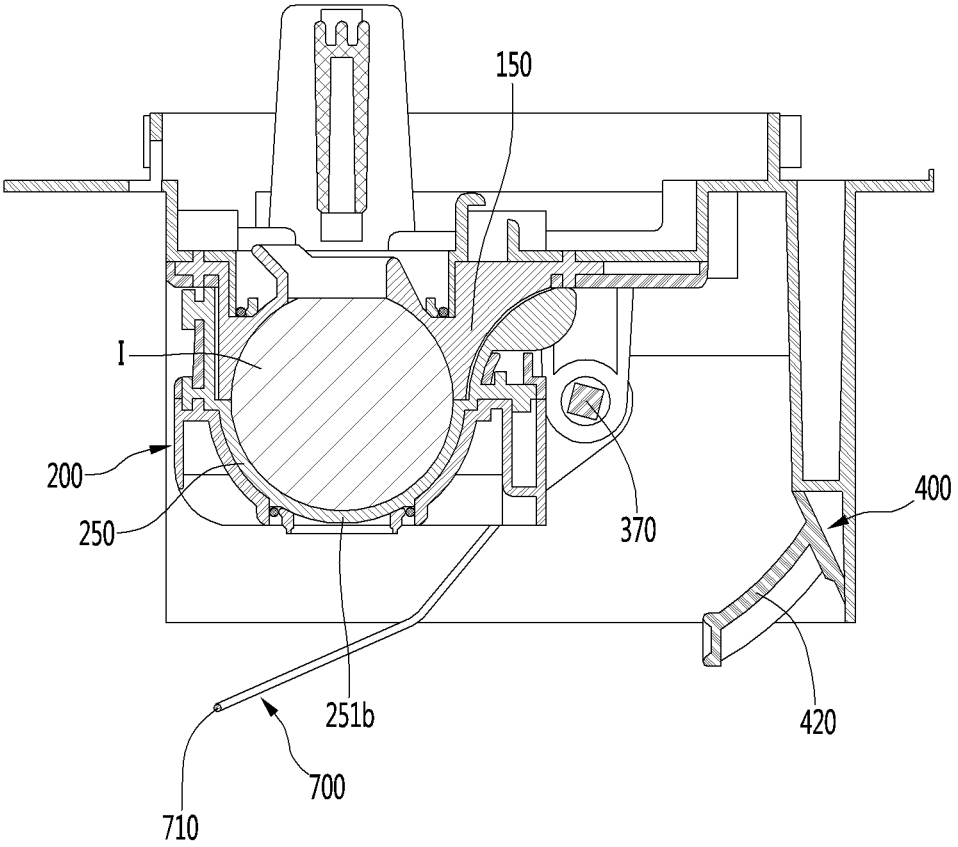
FIG. 10 is a view showing a state in which ice making is completed at an ice making position.
Figure 11:
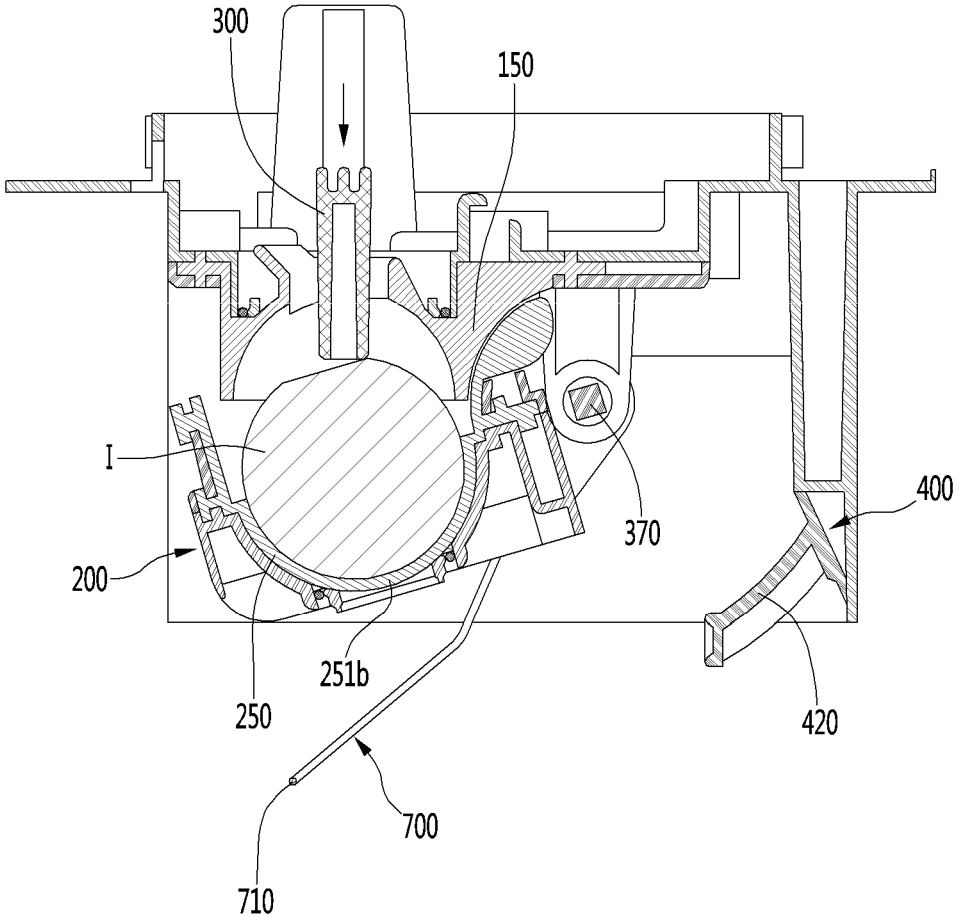
FIG. 11 is a view showing a lower tray at the beginning of ice transfer.
Figure 12:
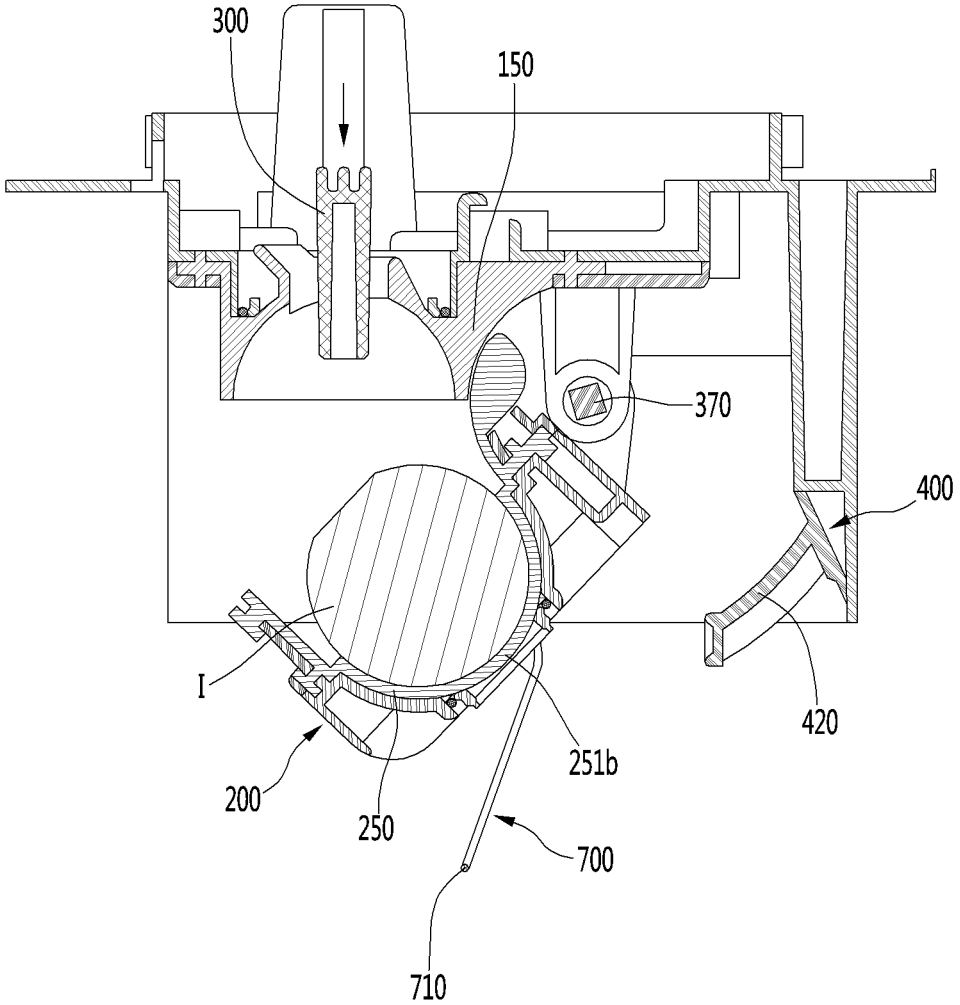
FIG. 12 is a view showing the position of a lower tray at a full ice detection position.
Figure 13:
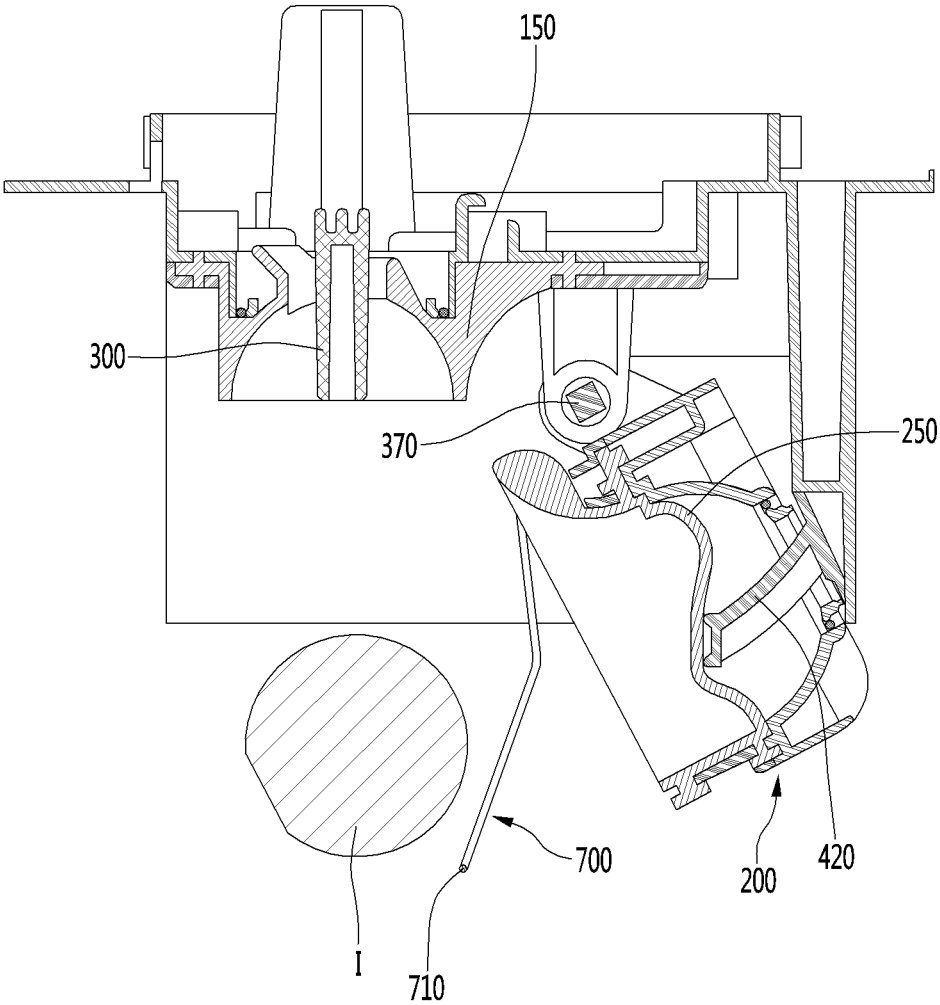
FIG. 13 is a view showing a lower tray at an ice transfer position.

FIG. 8 is a view showing a state in which water supply is completed in a state in which a lower tray is moved to a water supply position, FIG. 9 is a view showing a state in which a lower tray is moved to an ice making position, FIG. 10 is a view showing a state in which ice making is completed at an ice making position, FIG. 11 is a view showing a lower tray at the beginning of ice transfer, FIG. 12 is a view showing the position of a lower tray at a full ice detection position, and FIG. 13 is a view showing a lower tray at an ice transfer position.

Referring to FIGS. 8 to 13, in order to make the ice in the ice maker 100, the lower tray 250 is moved to the water supply position.

In this specification, a direction in which the lower tray 250 moves from the ice making position of FIG. 9 to the ice transfer position of FIG. 13 may be referred to as a forward movement (or forward rotation). In contrast, in a direction in which the lower tray 250 moves from the ice transfer position of FIG. 13 to the ice making position of FIG. 9 may be referred to as reverse movement (or reverse rotation).

When movement of the lower tray 250 to the water supply position is detected, the driving device 400 is stopped and water supply starts in a state in which the lower tray 250 moves to the water supply position.

After water supply is completed, the driving device 400 may operate to move the lower tray 250 to the ice making position. When the lower tray 250 moves in the reverse direction, the upper surface 251*e* of the lower tray 250 becomes close to the lower surface 151*a* of the upper tray 150.

Then, water between the upper surface 251*e* of the lower tray 250 and the lower surface 151*a* of the upper tray 150 is distributed to the plurality of lower chambers 252. When the upper surface 251*e* of the lower tray 250 and the lower surface 151*a* of the upper tray 150 are completely in contact with each other, water is filled in the upper chamber 152.

Movement of the lower tray 250 to the ice making position is detected by the Hall sensor 423 and, when movement of the lower tray 250 to the ice making position is detected, the driving device 400 is stopped.

Ice making starts in a state in which the lower tray 250 moves to the ice making position. For example, when the lower tray 250 reaches the ice making position, ice making may start. Alternatively, when the lower tray 250 reaches the ice making position and a water supply time exceeds a set time, ice making may start.

When ice making starts, the lower heater 296 is turned on and heat of the lower heater 296 is transferred into the ice chamber 111. When ice making is performed in a state in which the lower heater 296 is turned on, the ice is produced from the uppermost side in the ice chamber 111.

When ice making is completed, for ice transfer, one or more of the upper heater 148 and the lower heater 296 operate. When one or more of the upper heater 148 and the lower heater 296 is turned on, heat of the heaters 148 and 296 may be transferred to one or more of the upper tray 150 and the lower tray 250, such that the ice is detached from one or more surfaces (inner surfaces) of one or more of the upper tray 150 and the lower tray 250.

For ice transfer, the lower tray 250 may move in the forward direction. As shown in FIG. 11, when the lower tray 250 moves in the forward direction, the lower tray 250 is separated from the upper tray 150.

While the lower tray 250 moves from the ice making position of FIG. 9 to the full ice detection position of FIG. 12, the full ice of the ice bin 102 may be detected.

During ice transfer, upon determining that full ice of the ice bin 102 is not detected, the lower tray 250 may rotate to the ice transfer position as shown in FIG. 13. While the lower tray 250 moves to the full ice position, the lower tray 250 is brought into contact with the lower ejecting pin 332.

When the lower tray 250 continuously rotates in the forward direction in a state in which the lower tray 250 is in contact with the lower ejecting pint 332, the lower ejecting pin 332 presses the lower tray 250 to deform the lower tray 250, and the pressing force of the lower ejecting pin 332 is transferred to the ice such that the ice is detached from the surface of the lower tray 250. The ice detached from the surface of the lower tray 250 may be dropped downward and stored in the ice bin 102.

After the ice is detached from the lower tray 250, the lower tray 250 may rotate again by the driving device 400 and move to the water supply position.

In contrast, upon determining that the full ice of the ice bin 102 is detected, the lower tray 250 may rotate in the reverse direction, move to the water supply position, and wait for a set time until full ice is released.

Figure 14:
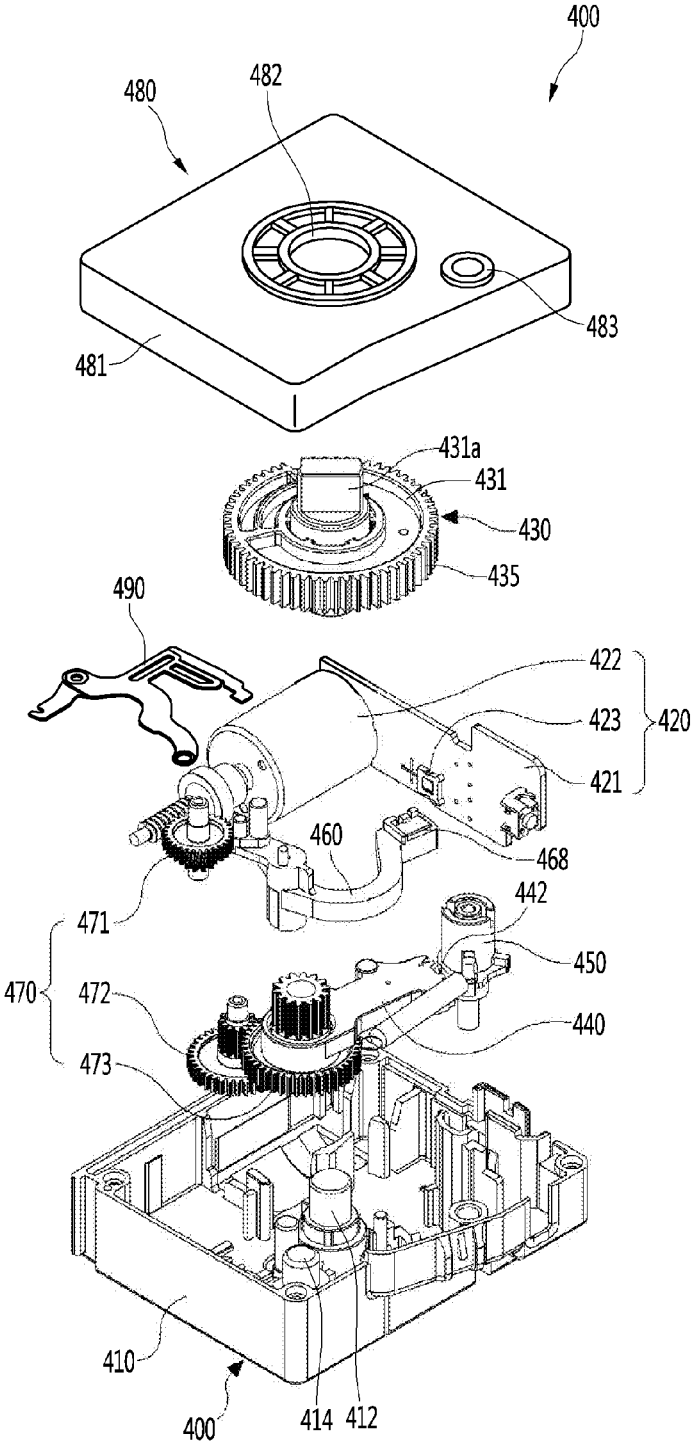
FIG. 14 is an exploded perspective view of a driving device according to an embodiment of the present disclosure.
Figure 15:
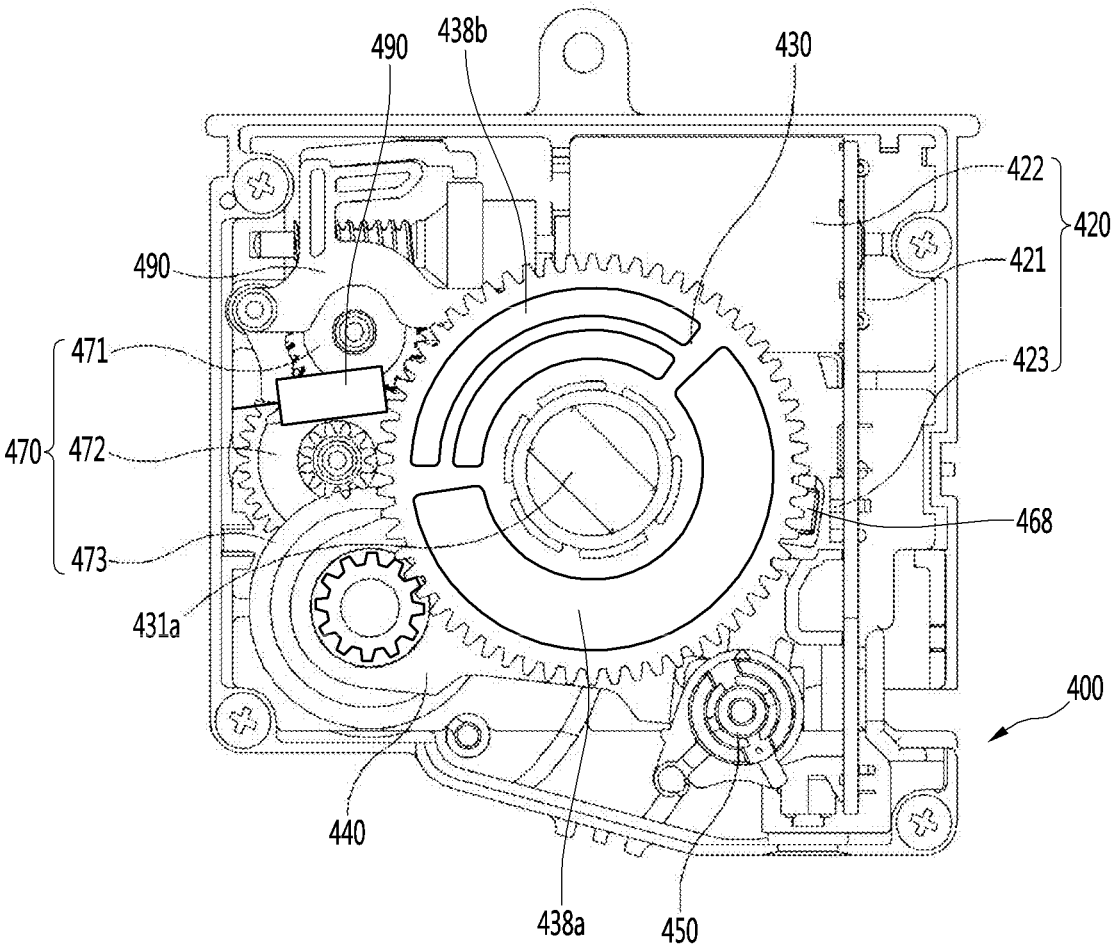
FIG. 15 is a plan view showing the internal configuration of a driving device according to an embodiment of the present disclosure.
Figure 16:
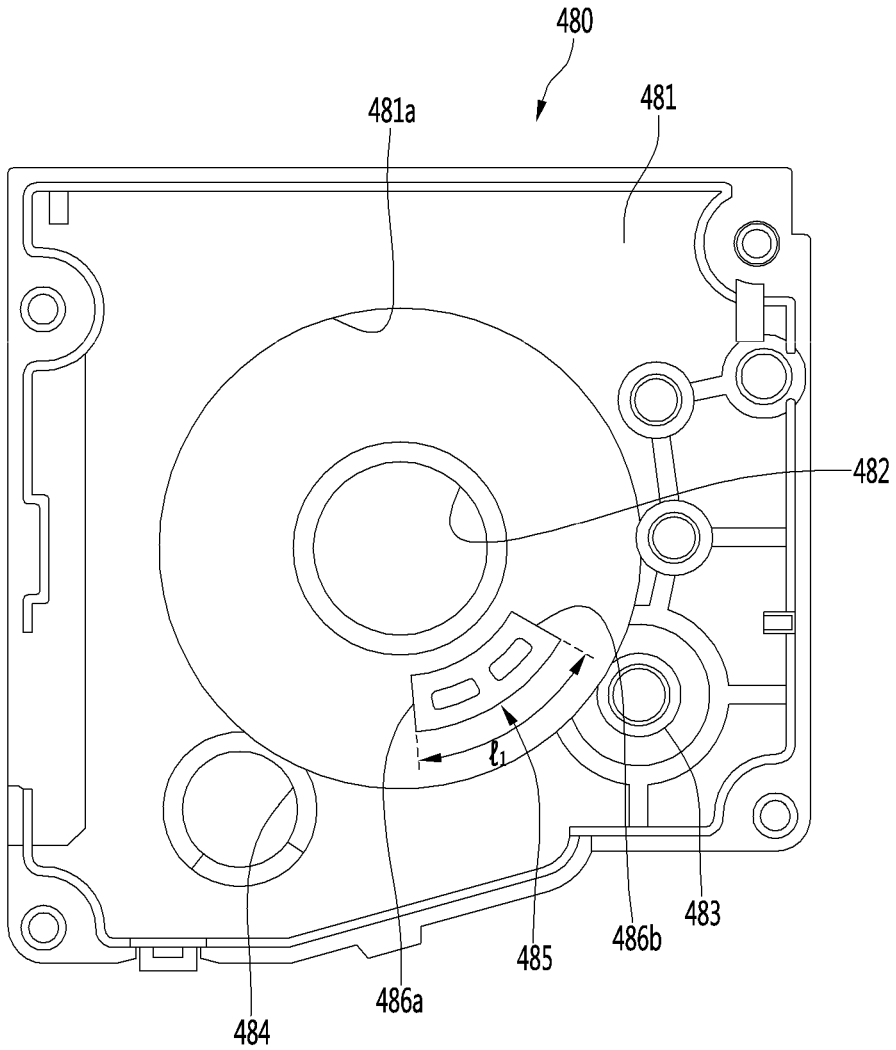
FIG. 16 is a bottom view showing the configuration of the bottom of a second case according to an embodiment of the present disclosure.

FIG. 14 is an exploded perspective view of a driving device according to an embodiment of the present disclosure, FIG. 15 is a plan view showing the internal configuration of a driving device according to an embodiment of the present disclosure, and FIG. 16 is a bottom view showing the configuration of the bottom of a second case according to an embodiment of the present disclosure.

Referring to FIGS. 14 to 16, the driving device 400 according to one embodiment of the present invention includes driving cases 410 and 480 forming appearance thereof and a plurality of parts provided in the driving cases 410 and 480.

The plurality of parts may include a driver 420, a cam gear 430 which rotates by the driver 420 to rotate the lower tray 250, a magnet lever 460 which moves along a first lever cam 436 of the cam gear 430, and an operation lever 440 which moves along a second lever cam 437 of the cam gear 430.

In addition, the driving device 400 may further include a lever coupler 450 which rotates by the operation lever 440 to rotate (swing) the full ice detection lever 700 to the left and right.

The driving cases 410 and 480 may include a first case 410, in which the driver 420, the cam gear 430, the operation lever 440, the lever coupler 450 and the magnet lever 460 are accommodated, and a second case 480 covering the first case 410.

The driver 420 may include a driving motor 422. The driving motor 422 generates power for rotating the cam gear 430.

The driver 420 may further include a control plate 421 coupled to the inside of the first case 410. The driving motor 422 may be connected to the control plate 421.

The control plate 421 may be provided with the Hall sensor 423. The Hall sensor 423 may output a first signal and a second signal according to the relative position with the magnet lever 460.

The second case 480 includes a case body 481 and first and second case holes 482 and 483 formed in the case body 481.

The cam gear 430 includes a circular gear body 431 and an upper shaft 431*a* protruding from the gear body 431 and coupled to the shaft bracket 354 of the connection unit 350 through the first case hole 482.

The cam gear 430 further includes a gear portion 435 provided along the circular edge of the gear body 431.

A restraining groove 438*a* recessed in a circumferential surface to have the restraining rib 485 of the second case inserted thereinto is formed in the front surface of the cam gear 430.

A reducing groove 438*b* recessed in the circumferential direction to reduce the mass of the cam gear 430 is formed in the front surface of the cam gear 430.

A reduction gear 470 for reducing the rotation force of the driving motor 422 to transfer the rotation force to the cam gear 430 may be provided between the cam gear 430 and the driving motor 422.

The reduction gear 470 may include a first reduction gear 471 connected to the driving motor 422 to transmit power, a second reduction gear 472 engaged with the first reduction gear 471, and a third reduction gear 473 for connecting the second reduction gear 472 with the cam gear 430 to transmit power.

One end of the operation lever 440 is rotatably inserted into and coupled to the rotation shaft of the third reduction gear 473, and the gear 442 formed on the other end thereof is connected to the lever coupler 450 to transmit power. That is, when the operation lever 440 moves, the lever coupler 450 rotates.

One end of the lever coupler 450 is rotatably connected to the operation lever 440 in the cases 410 and 480 and the other end thereof protrudes to the outside of the second case 480 through the second case hole 483 of the second case 480 to be connected to the full ice detection lever 700.

The magnet lever 460 may include a lever body 461 (see FIG. 17) rotatably provided in the cases 410 and 480, a first projection 463 organically interlocking along the first lever cam 436 of the cam gear 430, and a magnet 468 detected by the Hall sensor 423.

When the Hall sensor 423 detects the magnet 468 while the magnet lever 460 moves, the Hall sensor 423 outputs the first signal and, when the magnet 468 deviates from the Hall sensor 423, the Hall sensor 423 outputs the second signal.

The driving device 400 further includes a brake lever 490 for restricting rotation of the cam gear 430. The brake lever 490 includes a lever body 491, a coupling projection 491 provided at one side of the lever body 491 and coupled to the cases 410 and 480, and a brake projection 492 provided at the other side of the lever body 491.

Figure 22A:
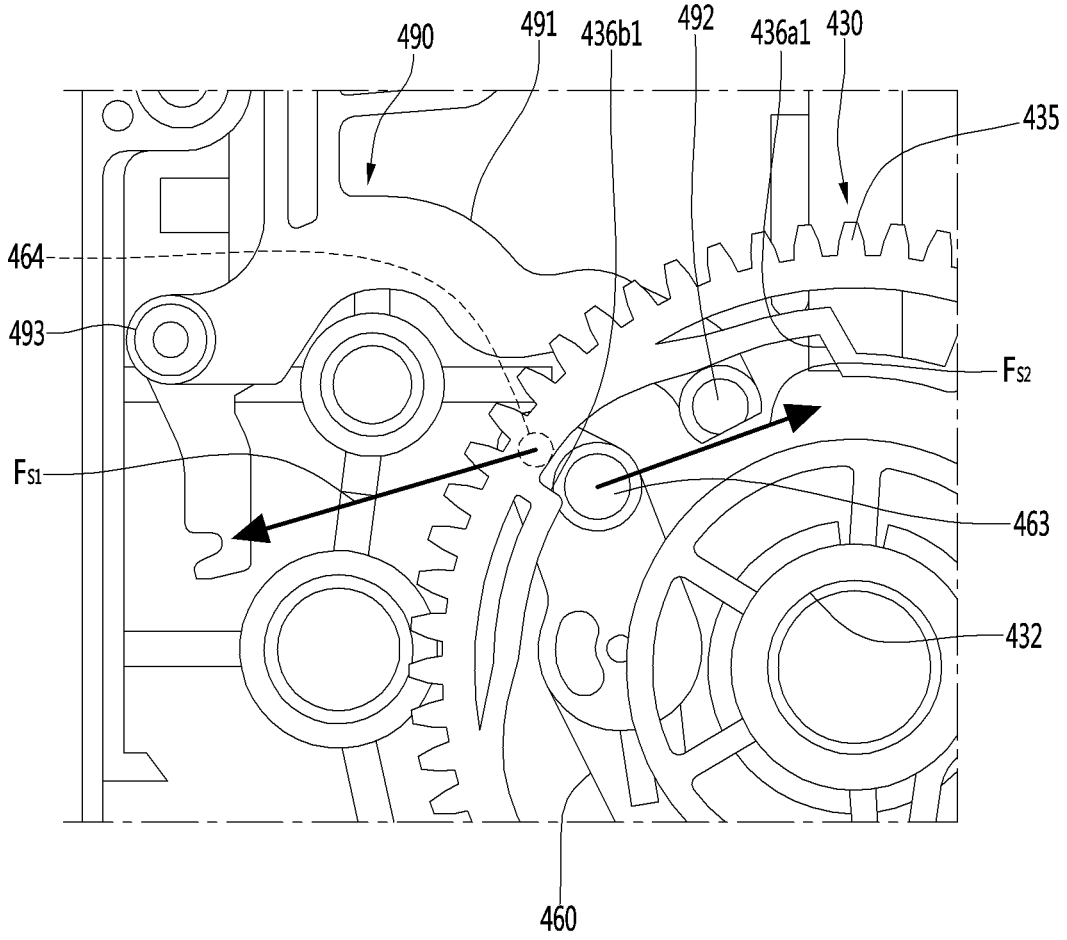
FIGS. 22*a* and 22*b* are views showing a state in which a lever shaft is distorted according to the position when a protrusion point and first and second inclined portions are provided in the cam surface of a cam gear according to an embodiment of the present disclosure.
Figure 22B:
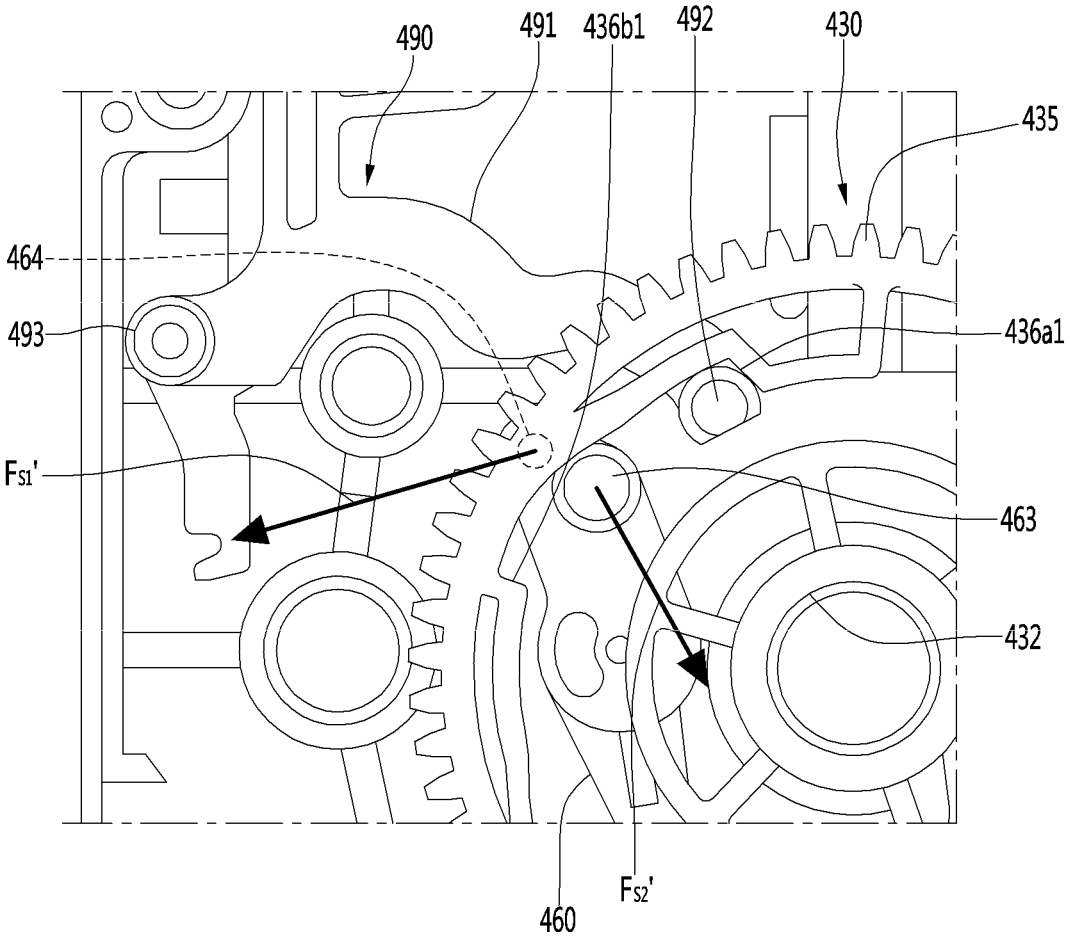

For example, when the lower tray 250 is located at the ice making position, the brake projection 492 may interfere with a step 436*a*1 provided on the first lever cam 436, thereby preventing the cam gear 430 from further moving counter-clockwise in FIG. 22*b*.

In contrast, when the lower tray 250 is located at the ice transfer position, the brake projection 492 may be in contact with the surface of the first lever cam 436.

The driving device 400 may further include an elastic member 490 coupled to the magnet lever 460 to provide restoring force to the magnet lever 460. One end of the elastic member 490 may be connected to the second projection 464 of the magnet lever 460 and the other end thereof may be fixed to the case 410 and 480.

The elastic member 490 may include, for example, a spring.

The second case 480 includes a first case hole 482 and a second case hole 483 formed in the case body 481. The upper shaft 431*a* of the cam gear 430 penetrates through the first case hole 482 and the lever coupler 450 penetrates through the second case hole 483.

A cam gear seating portion 481*a* on which the cam gear 430 is seated is formed in the case body 481, and the cam gear seating portion 481*a* is formed by depressing at least a portion of the case body 481.

The cam gear seating portion 481*a* is provided with a restraining rib 485. The restraining rib 485 may protrude from the cam gear seating portion 481*a* and may be inserted into the restraining groove 438*a* of the cam gear 430. When the cam gear 430 rotates, the restraining rib 485 may perform relative movement inside the cam gear seating portion 481*a*.

According to the rotation direction of the cam gear 430, both ends of the restraining rib 485 may interfere with both ends of the restraining groove 438*a*. Both ends of the restraining rib 485 include a first end 486*a* and a second end 486*b*.

When the cam gear 430 rotates in one direction, if the first end 486*a* interferes with one end of the restraining groove 438*a*, additional rotation of the cam gear 430 in one direction may be restricted.

In contrast, when the cam gear 430 rotates in the other direction, if the second end 486*b* interferes with the other end of the restraining groove 438*a*, additional rotation of the cam gear 430 in the other direction may be restricted.

The case body 481 includes a gear groove 484, into which at least a portion of the third reduction gear 473 is inserted.

The first case 410 includes a first shaft coupler 412 coupled to the lower shaft 432 (see FIG. 17) of the cam gear 430. The cam gear 430 may be rotatably supported on the first case 410 through the first shaft coupler 412.

The first case 410 further includes a second shaft coupler 414 coupled to the lever shaft 462 (see FIG. 17) of the magnet lever 460. The magnet lever 460 may be rotatably supported on the first case 410 through the second shaft coupler 414.

Figure 17:
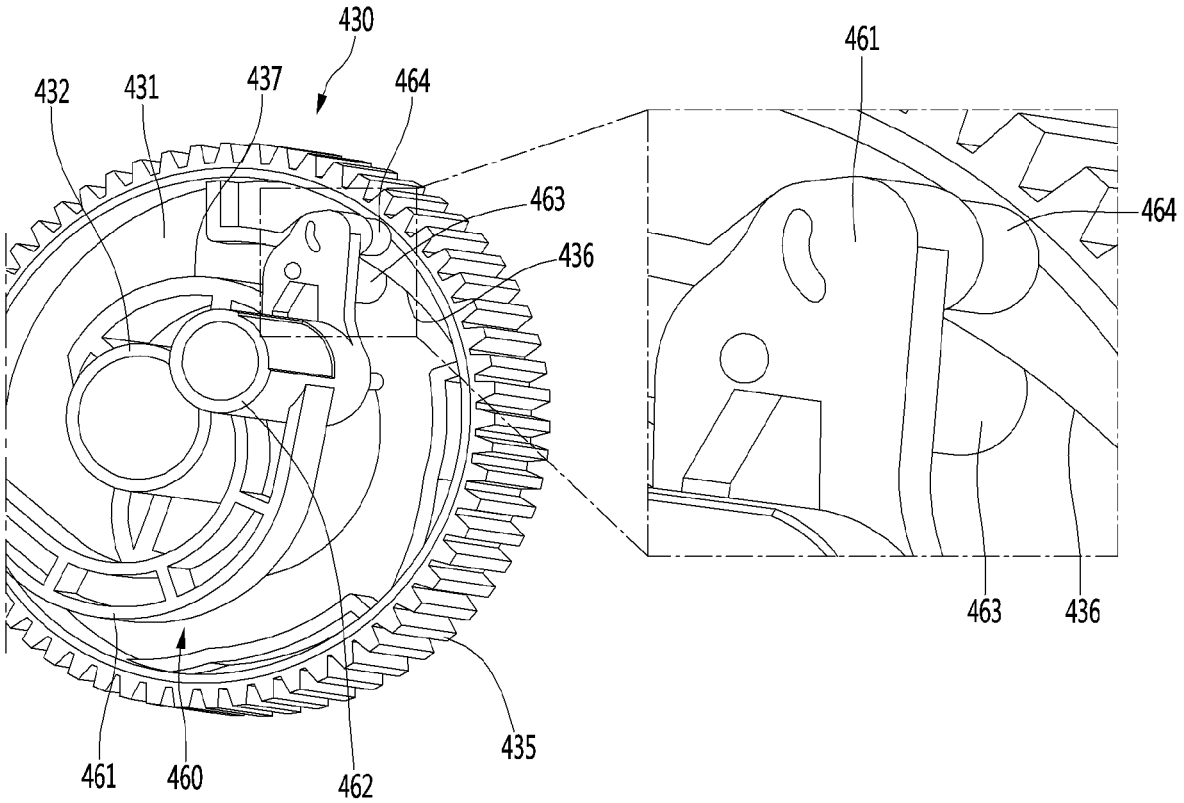
FIG. 17 is a perspective view showing the configuration of a cam gear and a magnet lever according to an embodiment of the present disclosure.
Figure 18:
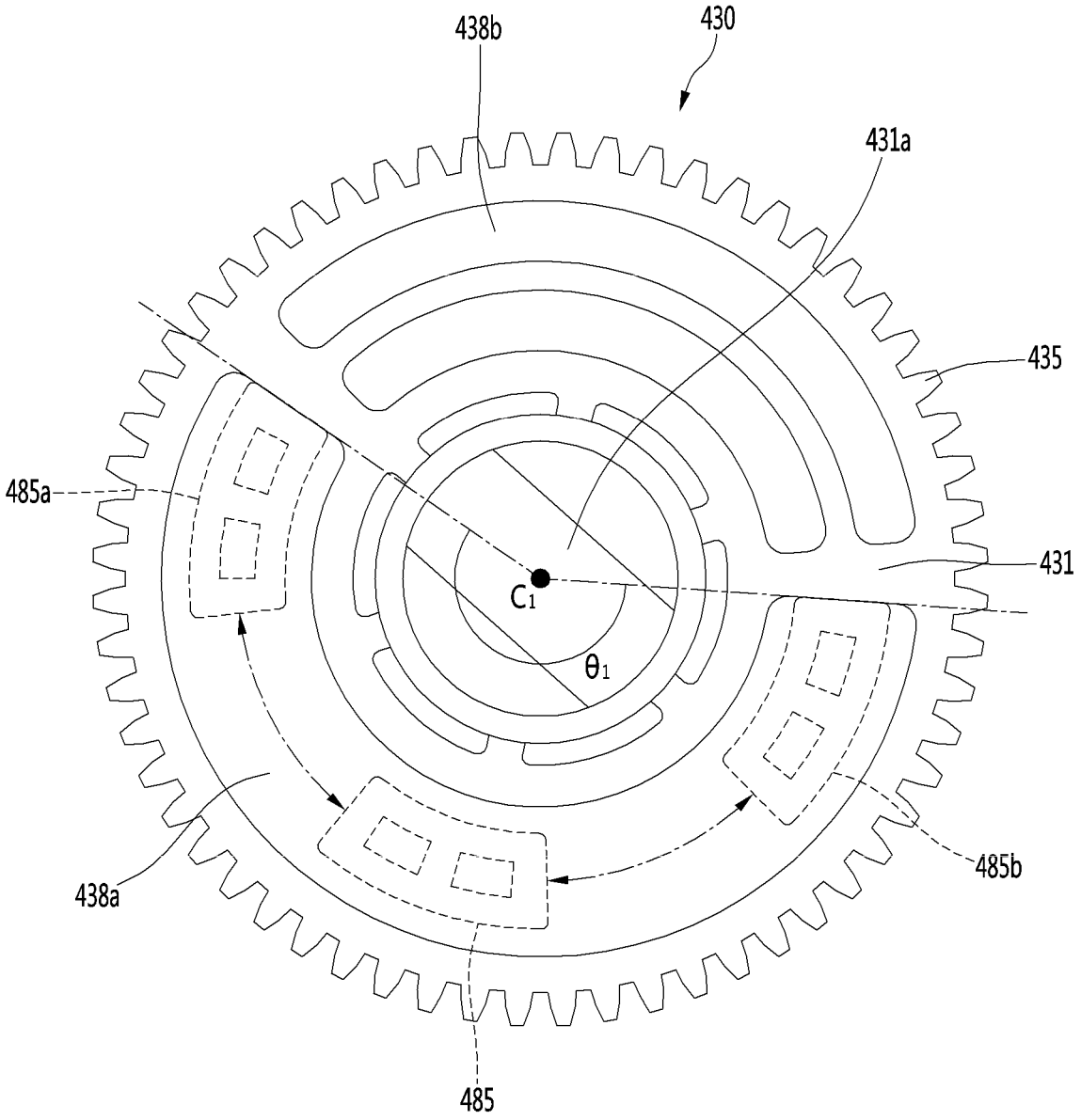
FIG. 18 is a view showing the front configuration of a cam gear according to an embodiment of the present disclosure.
Figure 19:
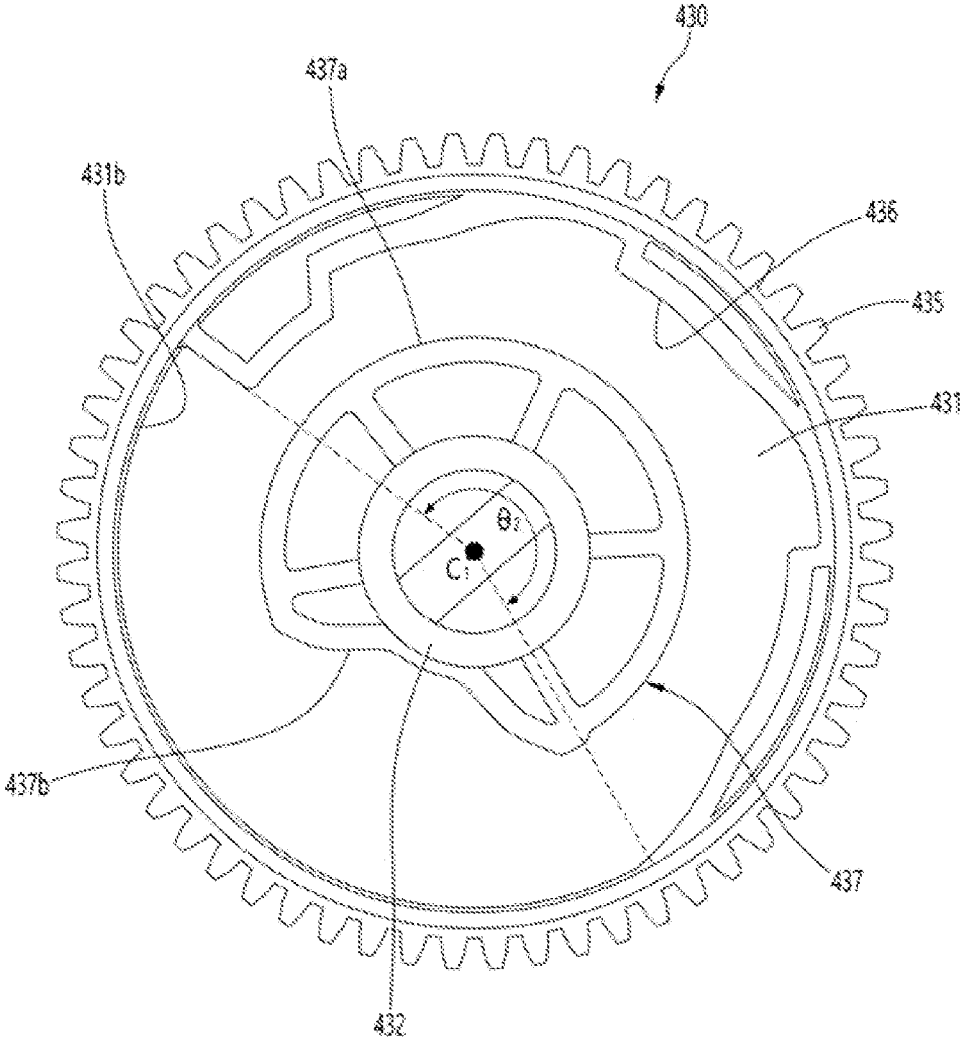
FIG. 19 is a view showing the rear configuration of a cam gear according to an embodiment of the present disclosure.

FIG. 17 is a perspective view showing the configuration of a cam gear and a magnet lever according to an embodiment of the present disclosure, FIG. 18 is a view showing the front configuration of a cam gear according to an embodiment of the present disclosure, and FIG. 19 is a view showing the rear configuration of a cam gear according to an embodiment of the present disclosure.

Referring to FIG. 17, the magnet lever 460 according to one embodiment of the present disclosure includes a lever body 461 having a rounded portion and the projections 463 and 464 provided on an end of the lever body 461 and protruding toward the cam gear 430.

A lever shaft 462 may be provided on one surface of the lever body 461 to protrude toward the first case 410, and the projections 463 and 464 may be provided on the other end of the lever body 461. One surface and the other surface of the lever body 461 may form opposite surfaces.

The lever shaft 462 may be disposed at a position closer to the projections 463 and 464 than the magnet 468 based on the center of the lever body 461.

The projections 463 and 464 include the first projection 463 which contacts the surface of the first lever cam 436 and moves along the surface of the first lever cam 436 when the cam gear 430 rotates.

The projections 463 and 464 include the second projection 464 connected to the elastic member 495 to receive the restoring force from the elastic member 495.

The cam gear 430 includes a gear body 431 having a disk shape and a gear portion 435 formed in the circumferential direction along the edge of the gear body 431.

The cam gear 430 further includes a lower shaft 432 protruding from one surface of the gear body 431, and the first lever cam 436 and the second lever cam 437 are provided on one surface of the gear body 431.

The restraining groove 438*a* and the reducing groove 438*b* may be formed in the other surface of the gear body 431. One surface of the gear body 431 and the other surface of the gear body 431 may form opposite surfaces.

Referring to FIGS. 18 and 19, the restraining groove 438*a* and the reducing groove 438*b* provided in the cam gear 430 are formed in the circumferential direction (in an arc shape).

The restraining groove 438*a* and the reducing groove 438*b* may be formed to have a constant radius of curvature based on the center C1 of the cam gear 430, that is, a portion where the upper shaft 431*a* is provided.

The center angle θ1 of the restraining groove 438*a* based on the center C1 of the cam gear 430 may be in a range of about 210° to 240°.

The center angle θ1 of the restraining groove 438*a* is determined in consideration of the rotation angle of the cam gear 430 with a predetermined safety factor, in correspondence with the range of the angles of the lower tray 250 located at the water supply position, the ice making position and the ice transfer position.

For example, the angle of the lower tray 250 at the water supply position shown in FIG. 8 may be 8°, the angle of the lower tray 250 at the ice making position shown in FIG. 9 may be −15°, and the angle of the lower tray 250 at the ice transfer position of FIG. 13 may be 120°.

Specifically, while the cam gear 430 rotates clockwise or counterclockwise in FIG. 18, the restraining rib 485 provided in the second case 480 may relatively move clockwise or counterclockwise inside the restraining groove 438*a*.

Since the restraining rib 485 is formed to have a predetermined length t1 in the circumferential direction (see FIG. 16), the center angle θ1 of the restraining groove 438*a* is understood as being determined in consideration of the length t1 of the restraining rib 485, the rotation range of the lower tray 250 and the rotation error which may occur when abnormal driving of the driver 400.

In FIG. 16, the restraining rib 485 is denoted by reference numeral 485*a* when the restraining rib 485 is located at a "first maximum rotation position" where interference with one end of the restraining groove 438*a* occurs, and is denoted by reference numeral 485*b* when the restraining rib 485 is located at a "second maximum rotation position" where interference with the other end of the restraining groove 438*a* occurs.

A plurality of reducing grooves 438*b* is provided, and the radius of curvature of any one of the plurality of reducing grooves 438*b* may be greater than that of another reducing groove.

One surface of the cam gear 430 includes first and second lever cams 436 and 437 for transferring the rotation force of the cam gear 430 to the magnet lever 460 and the operation lever 440.

The first lever cam 436 may protrude from a body edge portion 431*b* forming the circular edge of the cam gear 430 toward the center C1 of the cam gear 430.

The length of the first lever cam 436 protruding from the body edge portion 431*b* toward the center C1 of the cam gear 430 may vary in the circumferential direction.

The first lever cam 436 may extend in the circumferential direction, and the center angle 82 of the first lever cam 436 extending in the circumferential direction based on the center C1 of the cam gear 430 may be greater than 180° and less than 270°.

In addition, the second lever cam 437 is provided to surround the lower shaft 432 and is configured to include a first outer surface portion 437*a* having a constant distance from the center C1 of the cam gear 430 and a second outer surface portion 437*b* having a non-constant distance.

While the cam gear 430 rotates, the operation lever 440 may move along the surfaces of the first outer surface portion 437*a* and the second outer surface portion 437*b* of the second lever cam 437.

Figure 20:
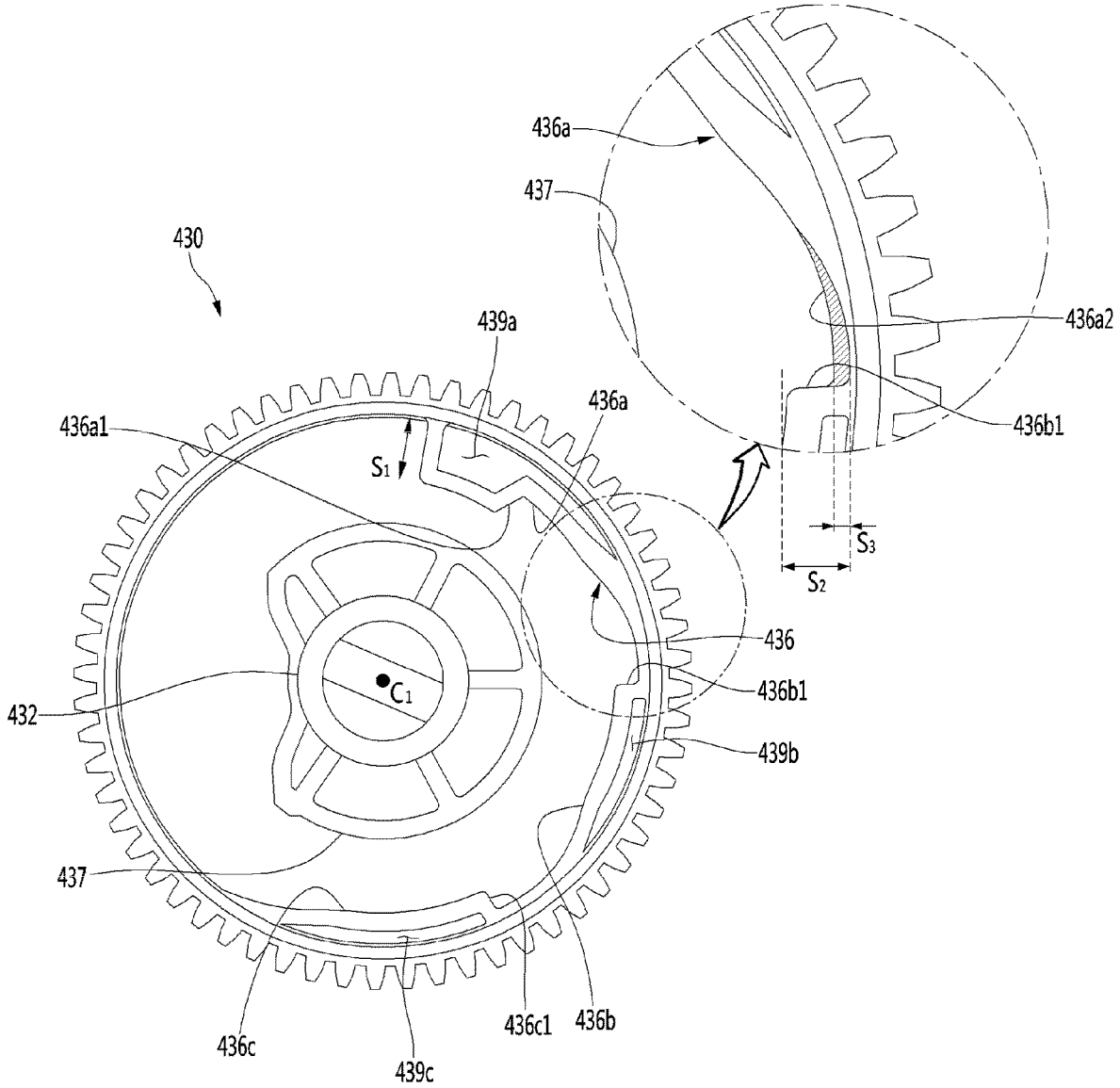
FIG. 20 is a view showing the configuration of a cam surface of a rear surface of a cam gear according to an embodiment of the present disclosure.
Figure 21A:
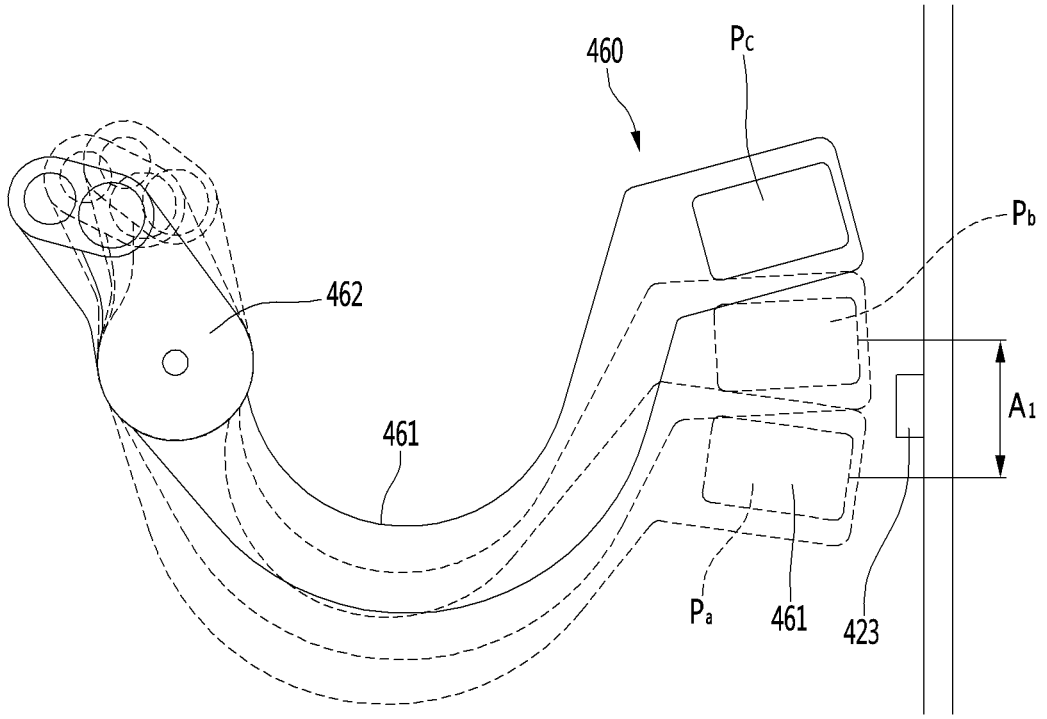
FIG. 21*a* is a view showing a state in which a magnet lever is located at a correct position and a false detection position.
Figure 21B:
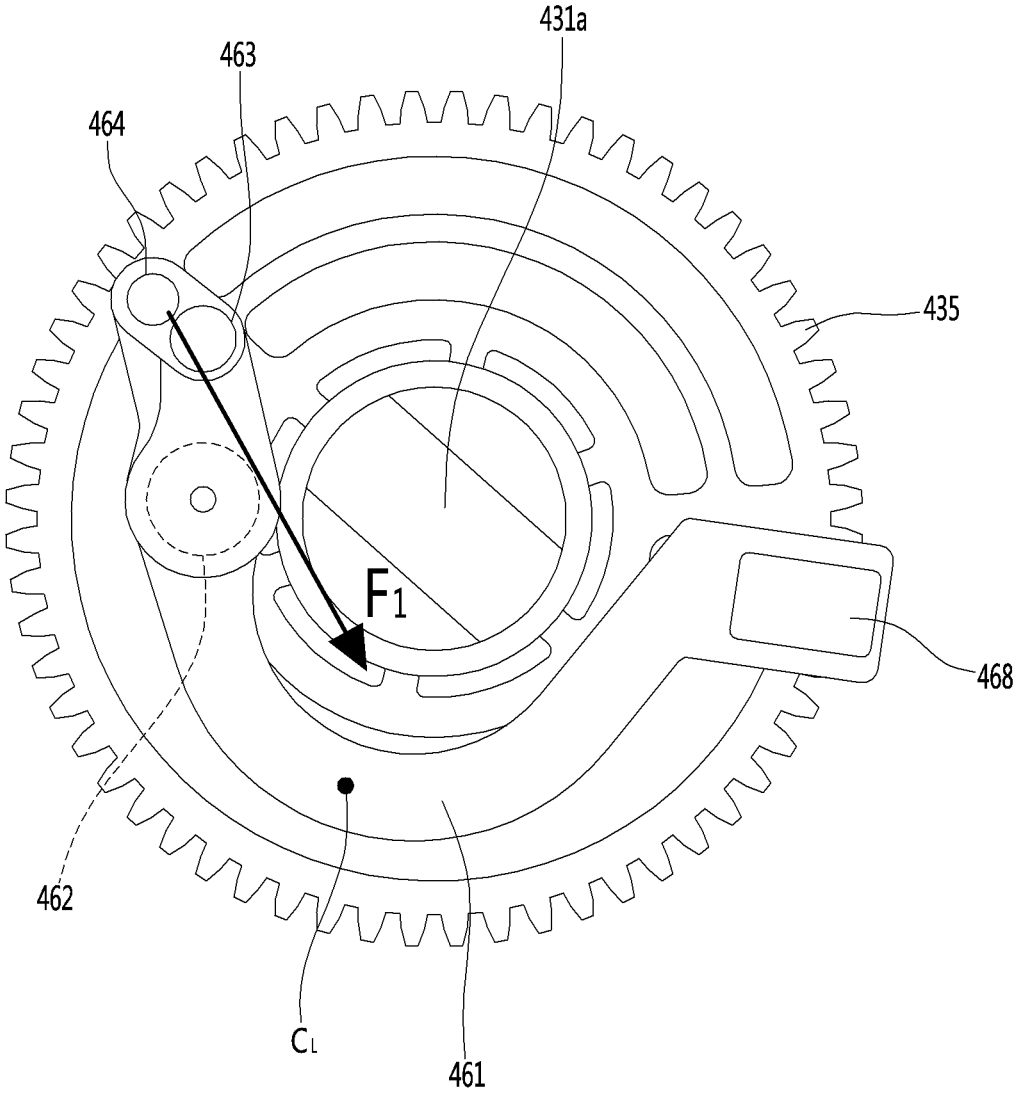
FIG. 21*b* is a view showing a state in which force is directly transferred from a cam gear to a magnet lever when the magnet lever is located at a false detection position.
Figure 21C:
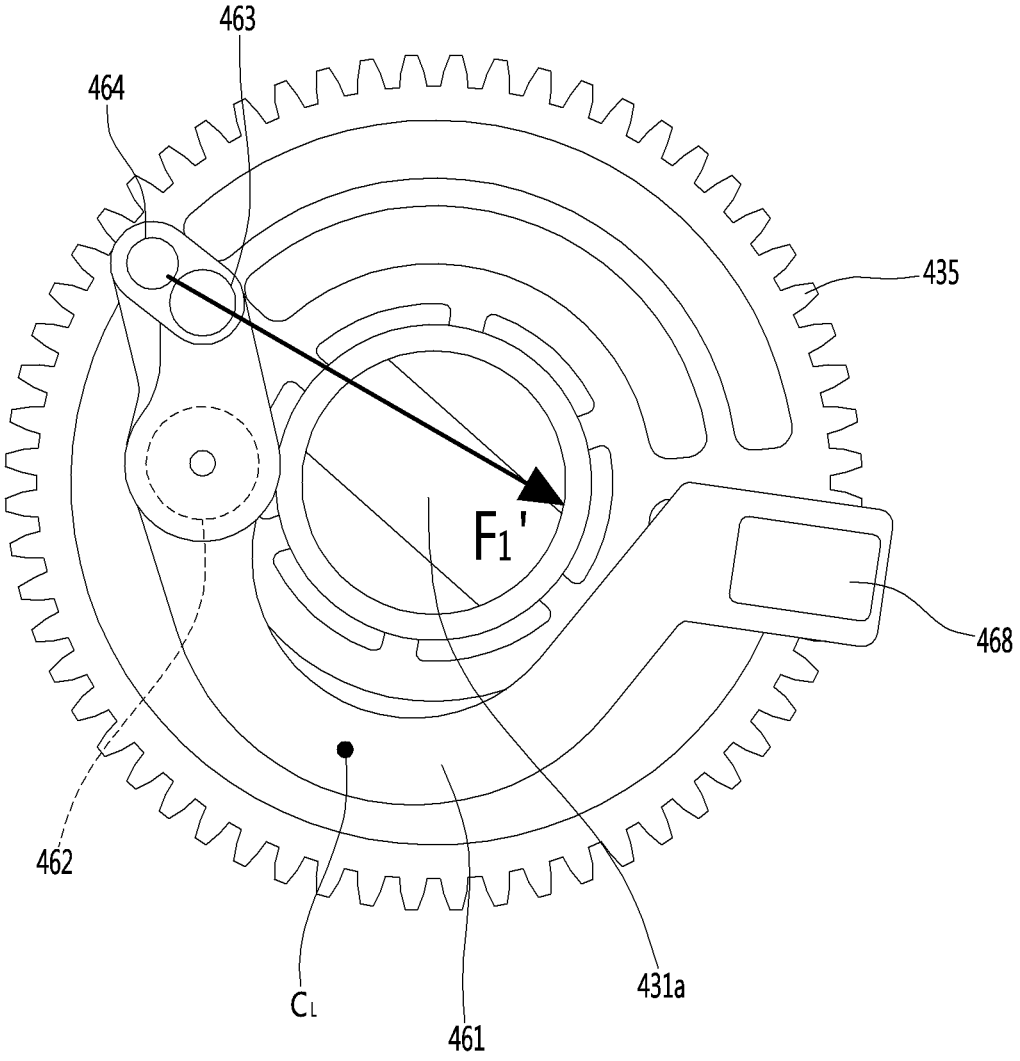
FIG. 21*c* is a view showing a state in which force is transferred from a cam gear to a magnet when the shape of the cam surface of a cam gear according to an embodiment of the present disclosure is implemented.

FIG. 20 is a view showing the configuration of a cam surface of a rear surface of a cam gear according to an embodiment of the present disclosure, FIG. 21*a* is a view showing a state in which a magnet lever is located at a correct position and a false detection position, FIG. 21*b* is a view showing a state in which force is directly transferred from a cam gear to a magnet lever when the magnet lever is located at a false detection position, and FIG. 21*c* is a view showing a state in which force is transferred from a cam gear to a magnet when the shape of the cam surface of a cam gear according to an embodiment of the present disclosure is implemented.

Referring to FIG. 20, the cam gear 430 according to an embodiment of the present disclosure includes a first lever cam 436, with which the magnet lever 460 is in contact.

The first lever cam 436 includes first to third cam portions 436*a*, 436*b* and 436*c* distinguished based on steps 436*a*1, 436*b*1 and 436*c*1. Each of the first to third cam portions 436*a*, 436*b* and 436*c* has a contact surface contacting the magnet lever 460. The contact surfaces respectively provided in the first to third cam portions 436*a*, 436*b* and 436*c* may be referred to as first to third contact surfaces.

A first groove 439*a* is formed between the first cam portion 436*a* and the body edge portion 431*b*. A second groove 439*b* is formed between the second cam portion 456*b* and the main edge portion 431*b*. A third groove 439*c* is formed between the third cam portion 436*c* and the body edge portion 431*b*.

The first step 436*a*1 forms one end of the first cam portion 436*a*. The first cam portion 436*a* may extend from the first step 436*a*1 in the circumferential direction (clockwise in FIG. 20), and the length of the first cam portion 436*a* protruding from the body edge portion 431*b* may be reduced clockwise.

The second step 436*b*1 forms one end of the second cam portion 436*b*. The second cam portion 436*b* may extend from the second step 436*b*1 in the circumferential direction (clockwise in FIG. 20) and the length of the second cam portion 436*b* protruding from the body edge portion 431*b* may be reduced clockwise.

The third step 436*c*1 forms one end of the third cam portion 436*c*. The third cam portion 436*c* may extend from the third step 436*c*1 in the circumferential direction (clockwise in FIG. 20) and the length of the third cam portion 436*c* protruding from the body edge portion 431*b* may be reduced clockwise.

The first cam portion 436*a* includes a step connector 436*a*2 connected to the second step 436*b*1. The step connector 436*a*2 may protrude from the body edge portion 431*b* toward the center C1 of the cam gear 430. In addition, the length (thickness) of the step connector 436*a*2 protruding from the body edge portion 431*b* toward the center C1 of the cam gear 430 may be constant in the circumferential direction.

The length (maximum thickness) of the first step 436*a*1 protruding from the body edge portion 431*b* to the center C1 of the cam gear 430 is defined as a first length S1, and the length (maximum thickness) of the second step 436*b*1 protruding from the body edge portion 431*b* toward the center C1 of the cam gear 430 is defined as a second length S2.

The first length S1 may be greater than the second length S2.

The length (thickness) of the step connector 436*a*2 protruding from the body edge portion 431*b* toward the center C1 of the cam gear 430 is defined as a third length S3.

The third length S3 may be less than the first length S1 and the second length S2.

Specifically, the third length S3 may be in a range of a set percent of the second length S2. For example, the third length S3 may have a value of 30% or more and 50% or less of the second length S2.

Referring to FIG. 21*a*, when the protruding third length S3 of the step connector 436*a*2 is too small, for example, when the third length S3 has a value less than 30% of the second length S2, the magnet lever 460 may be located at the detection error position PC because distortion or shaking occurs based on the lever shaft 462.

When the magnet lever 460 is in the correct-position range A1 (region between Pa and Pb), the Hall sensor 423 may easily detect the magnet 468 provided in the magnet lever 460.

However, when distortion or shaking of the magnet lever 460 occurs, the magnet lever 460 may move to the detection error position Pc. In this case, the Hall sensor 423 cannot detect the magnet 468, thereby incorrectly determining the position of the magnet lever 460.

The second cam portion 436*b* includes a step connector connected to the third step 436*c*1. The step connector of the second cam portion 436*b* may protrude from the body edge portion 431*b* toward the center C1 of the cam gear 430. The step connector of the second cam portion 436*b* may have the same configuration as the step connector 436*a*2 of the first cam portion 436*a*. In addition, the protrusion length of the third step 436*c*1 may be the same as the protruding length of the second step 436*b*1.

That is, the step connector of the second cam portion 436*b* is connected to the third step and has a constant thickness in the circumferential direction from the first step to the second step. In addition, the thickness of the step connector protruding from the body edge portion of the cam gear to the center is formed in a range of 30 to 50% of the maximum thickness S2 of the third step.

In addition, the third cam portion 436*c* includes a step connector. The step connector of the third cam portion 436*c* may protrude from the body edge portion 431*b* toward the center C1 of the cam gear 430. The step connector of the third cam portion 436*c* may have the same shape and size as the step connector 436*a*2 of the first cam portion 436*a* and the step connector of the second cam portion 436*b*.

FIG. 21*b* shows the magnitude and direction of force F1 applied from the cam gear 430 to the magnet lever 460 when the first projection 463 of the magnet lever 460 contacts the step connector 436*a*2 when the protruding third length S3 of the step connector 436*a*2 corresponds to 10% of the second length S2.

When the cam gear 430 rotates, force of the cam gear 430 pushing the magnet lever 460 acts in the vertical direction of the contact surface.

When the third length S3 corresponds to 10% of the second length S2 (in FIG. 20, a portion of the step connector excluding the hatched portion), force F1 transferred from the cam gear 430 may be directed to the center CL of the lever body 461 of the magnet lever 460 or a region adjacent to the lever body 461.

Accordingly, since F1 may act on the lever shaft 462, shaking or distortion may occur in the assembly tolerance portion of the first case 410 coupled with the lever shaft 462. In this case, the magnet lever 460 is more likely to move to the detection error position Pc.

In contrast, FIG. 21*c* shows the magnitude and direction of force F1' applied from the cam gear 430 to the magnet lever 460 when the first projection 463 of the magnet lever 460 contacts the step connector 436*a*2 when the protruding third length S3 of the step connector 436*a*2 corresponds to 35% of the second length S2.

When the third length S3 corresponds to 35% of the second length S2 (in FIG. 20, the entire portion of the step connector including the hatched portion), force F1' transferred from the cam gear 430 may be formed in a direction spaced apart from the center CL of the lever body 461 of the magnet lever 460.

Accordingly, since F1' does not act on the lever shaft 462, shaking or distortion is prevented from occurring in the assembly tolerance portion of the first case 410 coupled with the lever shaft 462. In this case, the magnet lever 460 is more likely to move to the correct positions Pa to Pb.

In summary, when the protruding length S3 of the step connector 436*a*2 is maintained at the set percent of the second length S2, force for pushing the magnet lever 460 to be away from the cam gear 430 is formed in a desired direction, thereby preventing abnormal operation of the magnet lever 460 and easily detecting the magnet 468 of the Hall sensor 423.

Figure 23:
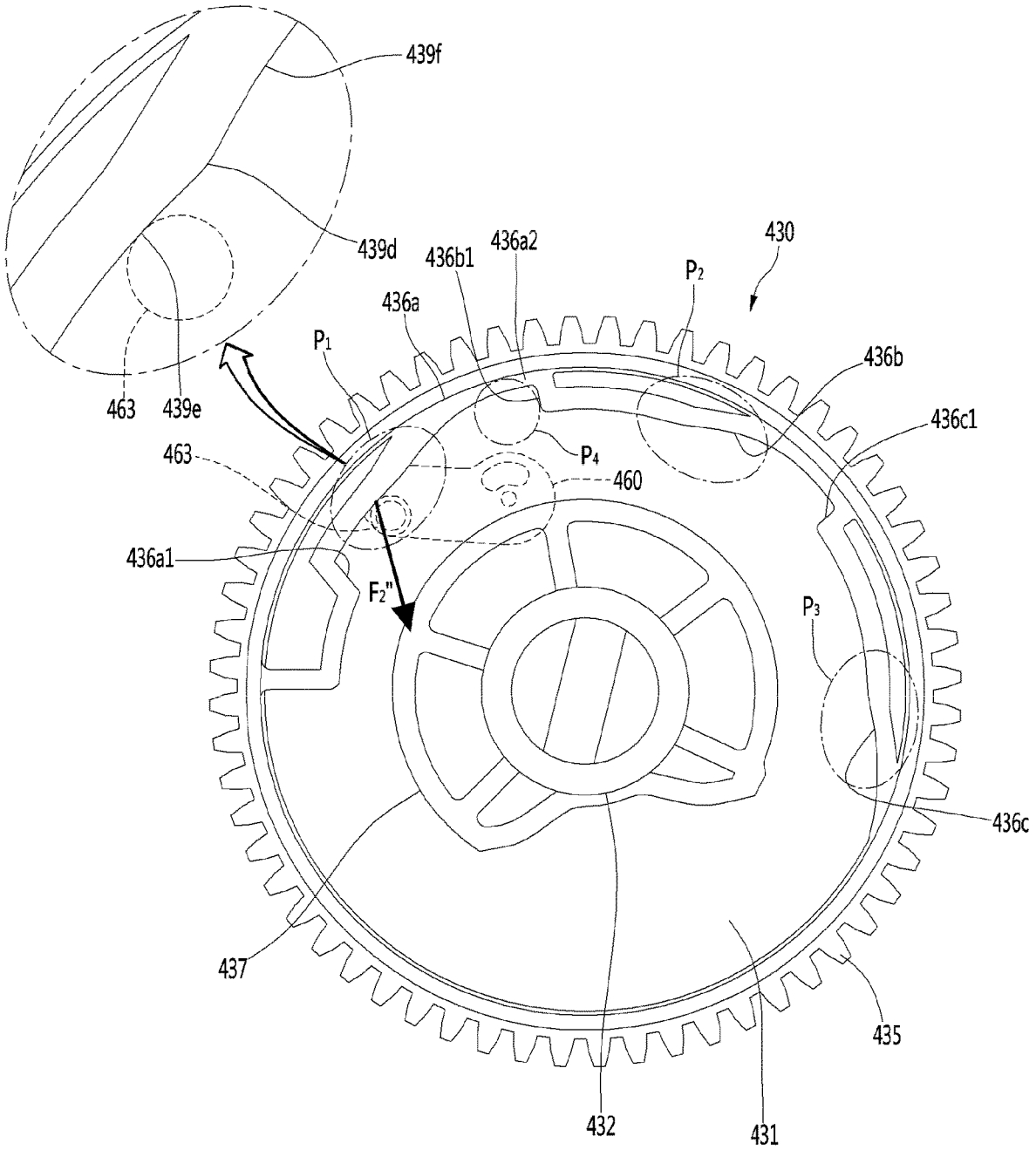
FIG. 23 is a view showing a state in which the protrusion point and the first and second inclined portions are provided in the cam surface of a cam gear according to an embodiment of the present disclosure.

FIGS. 22*a* and 22*b* are views showing a state in which a lever shaft is distorted according to the position when a protrusion point and first and second inclined portions are provided in the cam surface of a cam gear according to an embodiment of the present disclosure, and FIG. 23 is a view showing a state in which the protrusion point and the first and second inclined portions are provided in the cam surface of a cam gear according to an embodiment of the present disclosure.

FIG. 22*a* shows the position of the magnet lever 460 relative to the cam gear 430 when the lower tray 25 is located at a first position. In addition, FIG. 22*b* shows the position of the magnet lever 460 relative to the cam gear 430 when the lower tray 25 is located at a second position.

Referring to FIG. 22*a*, when the lower tray 250 is located at the first position, the first projection 463 of the magnet lever 460 may be locked to the second step 463*b*1. In addition, the second projection 464 may be elastically supported by the elastic member 495.

Force acting on the second projection 464 by the restoring force of the elastic member 495 forms first acting force Fs1 toward the outside of the cam gear 430. In addition, force acting on the first projection 463 by the second step 463*b*1 forms second acting force Fs2 acting in the opposite direction to Fs1.

Accordingly, the first acting force Fs1 and the second acting force Fs2 may cancel each other, thereby preventing distortion or shaking of the lever shaft 462 of the magnet lever 460.

In contrast, referring to FIG. 22*b*, when the lower tray 250 is located at the second position, the first projection 463 of the magnet lever 460 may be in contact with the surface of the first cam portion 436*a*. In addition, the second projection 464 may be elastically supported by the elastic member 495.

Force acting on the second projection 464 by the restoring force of the elastic member 495 forms first acting force Fs1' toward the outside of the cam gear 430. In addition, force acting on the first projection 463 by the surface of the first cam portion 436*a* substantially forms second acting force Fs2' toward the center C1 of the cam gear 430.

Accordingly, the first acting force Fs1' and the second acting force Fs2' act substantially in the vertical direction and thus do not cancel each other. In addition, since the second acting force Fs2' is directed toward the magnet lever 460, distortion or shaking of the lever shaft 462 of the magnet lever 460 may occur. As a result, abnormal operation (detection error position) of the magnet lever 460 may occur and thus the Hall sensor 423 cannot detect the magnet 468.

That is, it is necessary to provide a structure in which the second acting force Fs2' may act in the opposite direction to the first acting force Fs1' at the ice making position.

To this end, as shown in FIG. 23, an uneven structure may be provided in the first cam portion 436*a*. The uneven structure may be formed in the surface of the first cam portion 436*a*, with which the magnet lever 460 is in contact, when the lower tray 250 is located at the ice making position. A portion in which the uneven structure is provided is denoted by a first point P1.

Specifically, the uneven structure is provided in the surface of the first cam portion 436*a*, and includes a protrusion 439*d*, a first inclined portion 439*e* obliquely extending from the protrusion 439*d* toward the first step 436*a*1, and a second inclined portion 439*f* obliquely extending from the protrusion 439*d* toward the second step 436*b*1.

The first cam portion 436*a* extends from the first step 436*a*1 toward the first inclined portion 439*e* such that the length of the first cam portion from the body edge portion 431*b* decreases.

In addition, the protruding length increases while passing through the first inclined portion 439*e* and becomes maximum at the protrusion 439*d*.

The protruding length decreases from the protrusion 439*d* to the second inclined portion 439*f* and may decrease up to the step connector 436*a*2.

The first projection 463 of the magnet lever 460 may be in contact with the first inclined portion 439*e* at the ice making position. When the cam gear 430 rotates, the first inclined portion 439*e* pushes the first projection 463 and thus the second acting force F2" may act.

Since the second acting force F2" acts in a direction farther from the magnet lever 460 than the second acting force Fs' of FIG. 22*b*, it is possible to prevent distortion or shaking of the lever shaft 462 of the magnet lever 460.

The uneven structure may be further provided in the surface of the second cam portion 436*b* between the second step 436*b*1 and the third step 436*c*1. The uneven structure may be formed in the surface of the second cam portion 436*b*, with which the magnet lever 460 is in contact, when the lower tray 250 is at the full ice position. A portion in which the uneven structure is provided is denoted by a second point P2. For this uneven structure, refer to the uneven structure provided in the first cam portion 436*a*.

The uneven structure may be further provided in the surface of the third cam portion 436*c*. The uneven structure may be formed in the surface of the third cam portion 436*c*, with which the magnet lever 460 is in contact, when the lower tray 250 is located at the ice transfer position. A portion in which the uneven structure is provided is denoted by a third point P3. For this uneven structure, refer to the uneven structure provided in the first cam portion 436*a*.

For reference, a point P4 shown in FIG. 23 is a portion, with which the magnet lever 460 is in contact, when the lower tray 250 is located at the water supply position, and includes a portion in which the step connector 436*a*2 is formed.

Figure 24:
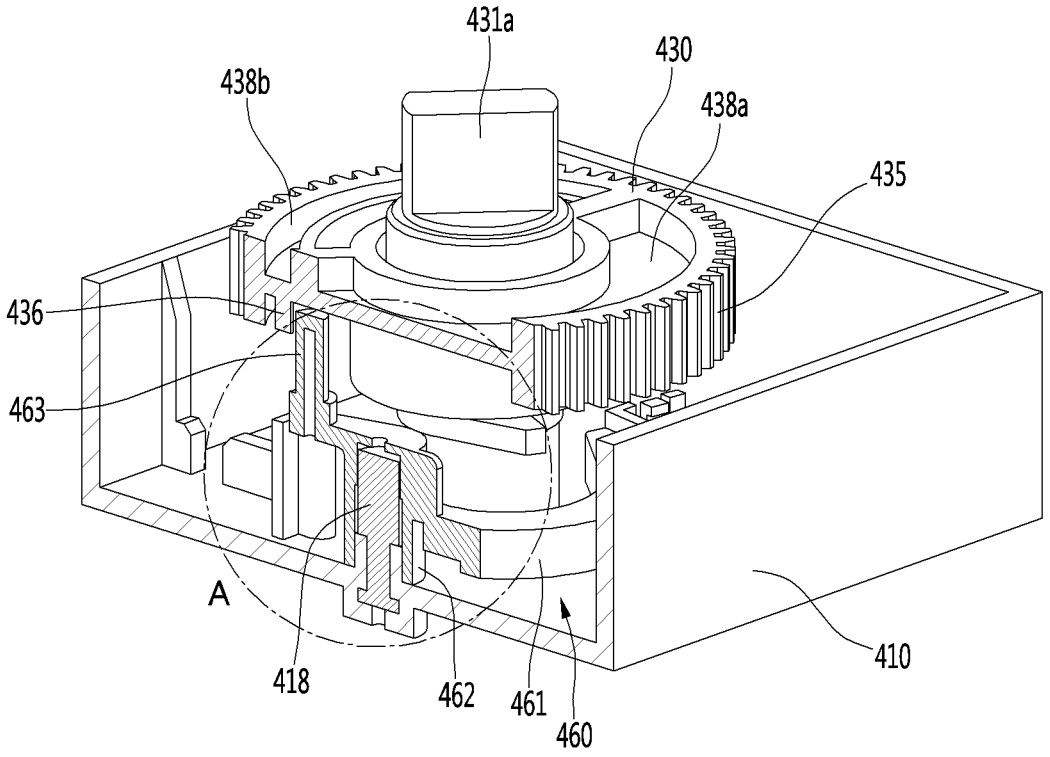
FIG. 24 is a partial cross-sectional view showing a state in which a magnet lever is coupled to a first case according to an embodiment of the present disclosure.
Figure 25:
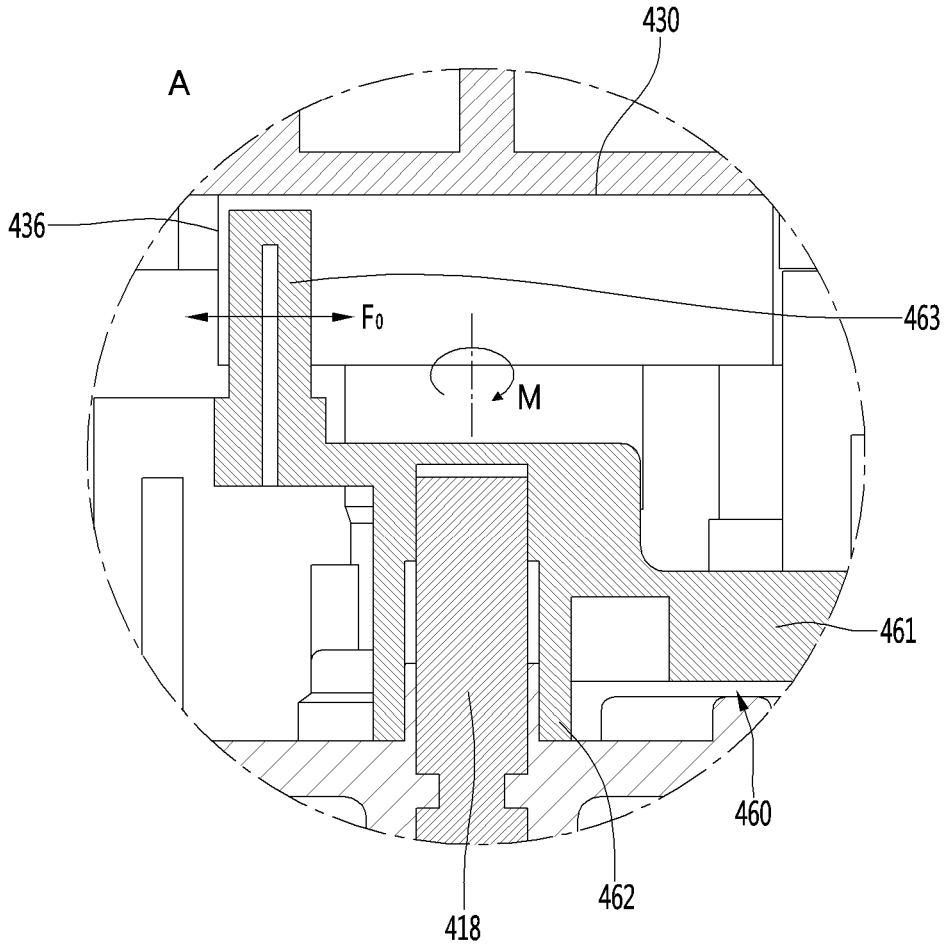
FIG. 25 is an enlarged view of a portion "A" of FIG. 24.

FIG. 24 is a partial cross-sectional view showing a state in which a magnet lever is coupled to a first case according to an embodiment of the present disclosure, and FIG. 25 is an enlarged view of a portion "A" of FIG. 24.

Referring to FIGS. 24 and 25, the magnet lever 460 according to the embodiment of the present disclosure may be rotatably provided at the lower portion of the first case 410.

A shaft support 418 inserted into the lever shaft 462 of the magnet lever 460 is provided at the lower surface of the first case 410. The shaft support 418 may be integrally formed with the first case 410.

For example, the shaft support 418 may be insert injected into the first case 410.

The first case 410 and the shaft support 418 may be made of stainless steel.

The shaft support 418 may be insert injected into the first case 410, thereby being firmly coupled to the first case 410.

While the cam gear 430 rotates, pressing force Fo acts from the cam gear 430 to the magnet lever 460, and the lever shaft 462 of the magnet lever 460 may provide frictional force or moment M to the shaft support 418 by the pressing force Fo.

In this process, when coupling force of the shaft support 418 and the first case 410 is weak, the shaft support 418 may be damaged, but the first case 410 and the shaft support 418 are integrally configured to prevent such a problem.

According to the embodiments, it is possible to prevent distortion or shaking of a magnet lever moving along a cam surface by improving the shape of the cam surface of a cam gear rotating by a driving motor.

Specifically, it is possible to reduce the magnitude of force directly transferred from a cam gear to a magnet lever by increasing the thickness of a cam surface protruding to the inside of the edge portion of a cam gear.

In addition, it is possible to increase a stroke transferred from a cam gear to a magnet lever, that is, pressing force or a pressing distance transferred from the cam gear to the magnet lever, by providing a structure protruding toward the center of the cam gear on each portion of a cam corresponding to the position (the water supply position, the ice making position or the ice transfer position) of a tray.

In addition, it is possible to reduce assembly tolerance between a magnet lever and a case, by integrally configuring the case and a shaft support capable of firmly supporting the shaft of the magnet lever supported on the case.

What is claimed is:

1. An ice maker comprising:

a tray that defines an ice chamber; and a driving device configured to move the tray, wherein the driving device comprises:

a driving motor, a cam gear configured to be rotated by the driving motor, the cam gear comprising a first lever cam that protrudes from an inner surface of the cam gear and that extends along a circumferential direction of the cam gear, and a lever configured to move along and in contact with the first lever cam, wherein the first lever cam comprises a plurality of cam portions that protrude from the inner surface of the cam gear toward a center of the cam gear and that have different protrusion heights with respect to the inner surface of the cam gear, and wherein at least one of the plurality of cam portions comprises a protrusion that defines a local maximum height that is greater than the protrusion heights of an adjacent area extending from the at least one of the plurality of cam portions.

2. The ice maker of claim 1, wherein the at least one of the plurality of cam portions further comprises a first inclined portion and a second inclined portion, and wherein the protrusion is disposed between the first inclined portion and the second inclined portion.

3. The ice maker of claim 2, wherein the protrusion height of the first inclined portion decreases as the first inclined portion extends away from the protrusion, and wherein the protrusion height of the second inclined portion decreases as the second inclined portion extends away from the protrusion.

4. The ice maker of claim 2, wherein the protrusion height of the first inclined portion decreases and then increases along the circumferential direction of the cam gear, and wherein the protrusion height of the second inclined portion decreases along the circumferential direction of the cam gear.

5. The ice maker of claim 2, wherein the first lever cam further comprises:

a first step that defines one end of a first cam portion of the plurality of cam portions; and a second step that defines one end of a second cam portion of the plurality of cam portions, and wherein the first cam portion extends from the first step to the second step in the circumferential direction, and the second cam portion extends from the second step in the circumferential direction.

6. The ice maker of claim 5, wherein the first inclined portion is disposed between the first step and the protrusion, and the second inclined portion is disposed between the protrusion and the second step.

7. The ice maker of claim 6, wherein the protrusion height of the first inclined portion decreases and then increases along the circumferential direction of the cam gear, and wherein the protrusion height of the second inclined portion decreases the circumferential direction of the cam gear.

8. The ice maker of claim 1, wherein the cam gear comprises a body edge portion that defines a circular edge of the cam gear, wherein the first lever cam protrudes from the body edge portion of the cam gear toward the center of the cam gear, and wherein the first lever cam defines at least one groove between the plurality of cam portions and the body edge portion.

9. The ice maker of claim 1, wherein the driving device further comprises a gear part configured to transfer rotation force of the driving motor to the cam gear.

10. The ice maker of claim 9, wherein the cam gear further comprises a gear portion that is disposed on an outer surface of the cam gear and coupled to the gear part.

11. The ice maker of claim 1, wherein the first lever cam further comprises:

a first step that defines one end of a first cam portion of the plurality of cam portions; and a second step that defines one end of a second cam portion of the plurality of cam portions, and wherein the first cam portion comprises a step connector connected to the second step, wherein the protrusion height of the step connector protruding from the inner surface of the cam gear toward the center of the cam gear is constant along the circumferential direction.

12. The ice maker of claim 11, wherein a step height of the first step is greater than a step height of the second step, and the step height of the second step is greater than a height of the step connector with respect to the inner surface of the cam gear.

13. The ice maker of claim 12, wherein the height of the step connector is greater than or equal to 30% of the step height of the second step and less than or equal to 50% of the step height of the second step.

14. The ice maker of claim 1, wherein the cam gear further comprises:

a shaft; and a second lever cam that surrounds the shaft, and wherein the driving device further comprises a second lever configured to move along and in contact with the second lever cam.

15. The ice maker of claim 14, further comprising a full ice detection lever configured to detect an amount of ice in an ice bin, and wherein the second lever is configured to move the full ice detection lever.

16. A refrigerator comprising:

a cabinet that defines a storage space; and an ice maker disposed in the storage space, wherein the ice maker comprises:

a tray that defines an ice chamber, and a driving device that is configured to move the tray, wherein the driving device comprises:

a driving motor, a cam gear configured to be rotated by the driving motor, the cam gear comprising a first lever cam that protrudes from an inner surface of the cam gear and that extends along a circumferential direction of the cam gear, and a first lever configured to move along and in contact with the first lever cam, and wherein the first lever cam comprises a plurality of cam portions that protrude from the inner surface of the cam gear toward a center of the cam gear and that have different protrusion heights with respect to the inner surface of the cam gear, and wherein at least one of the plurality of cam portions comprises a protrusion that defines a local maximum height that is greater than the protrusion heights of an adjacent area extending from the at least one of the plurality of cam portions.

17. The refrigerator of claim 16, wherein the at least one of the plurality of cam portions further comprises a first inclined portion and a second inclined portion, wherein the protrusion is disposed between the first inclined portion and the second inclined portion, wherein the protrusion height of the first inclined portion decreases as the first inclined portion extends away from the protrusion, and wherein the protrusion height of the second inclined portion decreases as the second inclined portion extends away from the protrusion.

18. The refrigerator of claim 17, wherein the first lever cam further comprises:

a first step that defines one end of a first cam portion of the plurality of cam portions; and a second step that defines one end of a second cam portion of the plurality of cam portions, wherein the first cam portion extends from the first step to the second step in the circumferential direction, and the second cam portion extends form the second step in the circumferential direction.

19. The refrigerator of claim 18, wherein the first inclined portion is disposed between the first step and the protrusion, and the second inclined portion is disposed between the protrusion and the second step.

20. The refrigerator of claim 19, wherein the protrusion height of the first inclined portion decreases and then increases along the circumferential direction of the cam gear, and wherein the protrusion height of the second inclined portion decreases the circumferential direction of the cam gear.

* * * * *